US009892874B2

(12) United States Patent
Chen

(10) Patent No.: US 9,892,874 B2
(45) Date of Patent: Feb. 13, 2018

(54) LUMINOUS KEYBOARD

(71) Applicant: Primax Electronics Ltd., Neihu, Taipei (TW)

(72) Inventor: Chung-Yuan Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 162 days.

(21) Appl. No.: 14/831,395

(22) Filed: Aug. 20, 2015

(65) Prior Publication Data

US 2017/0004936 A1 Jan. 5, 2017

(30) Foreign Application Priority Data

Jul. 3, 2015 (TW) ..... 104121673 A

(51) Int. Cl.

*G02B 6/38* (2006.01)
*H01H 13/83* (2006.01)
*H01H 3/12* (2006.01)

(52) U.S. Cl.

CPC ..... *H01H 13/83* (2013.01); *H01H 3/125* (2013.01); *H01H 2219/06* (2013.01); *H01H 2219/062* (2013.01); *H01H 2219/064* (2013.01)

(58) Field of Classification Search

CPC .. H01H 13/83; H01H 13/125; H01H 2219/06; H01H 2219/062; H01H 2219/064; G02B 6/00; G02B 6/0011; F21K 9/52

USPC ..... 362/615, 23.03

See application file for complete search history.

(56) References Cited

U.S. PATENT DOCUMENTS

| | | | | |
|---|---|---|---|---|
| 7,876,489 | B2 * | 1/2011 | Gandhi | G02B 6/0035 359/242 |
| 2011/0158728 | A1 * | 6/2011 | Ho | H01H 3/125 400/472 |
| 2013/0250611 | A1 * | 9/2013 | Lee | G02B 6/005 362/607 |
| 2014/0369020 | A1 * | 12/2014 | Chen | H01H 13/83 362/23.03 |
| 2014/0369067 | A1 † | 12/2014 | Chen | |

* cited by examiner
† cited by third party

*Primary Examiner* — Elmito Breval
*Assistant Examiner* — Omar Rojas Cadima
(74) *Attorney, Agent, or Firm* — Kirton McConkie; Evan R. Witt

(57) ABSTRACT

A luminous keyboard includes a keypad module, plural light-emitting elements, a light guide plate and a reflecting plate. The reflecting plate has plural light amount control structures. The light amount control structures are disposed on the reflecting plate, and located near the corresponding light-emitting elements. When the plural light-emitting elements emit light beams, the portions of the light beams that are not subjected to total internal reflection within the light guide plate are reflected by the reflecting plate. When the light beams are transferred through the light amount control structure, the reflected fraction of the light beams is reduced. Since the light beams are not very centralized, the problem of generating bright spots will be diminished.

7 Claims, 22 Drawing Sheets

LUMINOUS KEYBOARD

FIELD OF THE INVENTION

The present invention relates to a keyboard, and more particularly to a luminous keyboard with an illuminating function.

BACKGROUND OF THE INVENTION

Generally, the widely-used peripheral input device of a computer system includes for example a mouse device, a keyboard, a trackball device, or the like. Via the keyboard, characters and symbols can be inputted into the computer system directly. As a consequence, most users and most manufacturers of input devices pay much attention to the development of keyboards.

FIG. 1 is a schematic top view illustrating the outer appearance of a conventional keyboard. As shown in FIG. 1, there are plural keys 10 on a surface of the conventional keyboard 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard 1 is a keyboard for a notebook computer.

With the maturity of the computing technologies, the keyboard manufacturers make efforts in designing novel keyboards with special functions in order to meet diversified requirements of different users. For this reason, luminous keyboards are favored by users. The outer appearance of the conventional luminous keyboard is substantially similar to the outer appearance of the conventional keyboard 1. Since the luminous keyboard provides the function of illuminating the keys, the inner structure of the luminous keyboard is different from the inner structure of the keyboard without the illuminating function. Hereinafter, the inner structure of the luminous keyboard will be illustrated in more details. FIG. 2 is a schematic cross-sectional view illustrating a conventional luminous keyboard. As shown in FIG. 2, the conventional luminous keyboard 2 comprises plural keys 20, a membrane switch circuit member 21, a light guide plate 22, a backlight module 23, a supporting plate 24 and a reflecting plate 25. Each key 20 comprises a keycap 201, a scissors-type connecting element 202 and an elastic element 203. From top to bottom, the keycap 201, the scissors-type connecting element 202, the elastic element 203, the membrane switch circuit member 21, the supporting plate 24, the light guide plate 22 and the reflecting plate 25 of the conventional luminous keyboard 2 are sequentially shown. The backlight module 23 is located at a side of the membrane switch circuit member 22. For example, the conventional luminous keyboard 2 is a keyboard for a notebook computer (not shown).

In the key 20, the keycap 201 is exposed outside the conventional luminous keyboard 2, so that the keycap 201 can be depressed by the user. The scissors-type connecting element 202 is used for connecting the keycap 201 and the supporting plate 24. The elastic element 203 is penetrated through the scissors-type connecting element 202. In addition, both ends of the elastic element 203 are contacted with the keycap 201 and the membrane switch circuit member 21, respectively. The membrane switch circuit member 21 comprises an upper wiring board 211, a spacer layer 212, and a lower wiring board 213. The upper wiring board 211, the spacer layer 212 and the lower wiring board 213 are all made of a light-transmissible material. The light-transmissible material is for example polycarbonate (PC) or polyethylene (PE). The upper wiring board 211 has plural upper contacts 2111. The spacer layer 212 is disposed under the upper wiring board 211, and comprises plural perforations 2121 corresponding to the plural upper contacts 2111. The lower wiring board 213 is disposed under the spacer layer 212, and comprises plural lower contacts 2131 corresponding to the plural upper contacts 2111. The plural lower contacts 2131 and the plural upper contacts 2111 are collectively defined as plural key switches 214.

The backlight module 23 comprises an illumination circuit board 231 and plural light-emitting elements 232. For clarification and brevity, only two light-emitting elements 232 are shown in the drawing. The illumination circuit board 231 is disposed under the membrane switch circuit member 21 for providing electric power to the plural light-emitting elements 232. The plural light-emitting elements 232 are disposed on the illumination circuit board 231. In addition, the plural light-emitting elements 232 are inserted into plural reflecting plate openings 251 of the reflecting plate 25 and plural light guide plate openings 221 of the light guide plate 22, respectively. By acquiring the electric power, the plural light-emitting elements 232 are driven to emit plural light beams B. Moreover, the plural light beams B are introduced into the light guide plate 22. For example, the plural light-emitting elements 232 are side-view light emitting diodes. The plural light beams B are subjected to total internal reflection within the light guide plate 22, and thus the plural light beams B are guided to the keycaps 201 by the light guide plate 22. As shown in FIG. 2, the supporting plate 24 is arranged between the membrane switch circuit member 21 and the light guide plate 22 for supporting the keycap 201, the scissors-type connecting element 202, the elastic element 203 and the membrane switch circuit member 21. The reflecting plate 25 is disposed under the light guide plate 22 for reflecting the plural light beams B. Consequently, the plural light beams B are directed upwardly, and the utilization efficiency of the light beams B is enhanced.

In the conventional luminous keyboard 2, each keycap 201 has a light-outputting zone 2011. The light-outputting zone 2011 is located at a character region or a symbol region of the keycap 201. Moreover, the position of the light-outputting zone 2011 is aligned with the position of a corresponding light-guiding dot 223 of the light guide plate 22. The light beams B can be guided upwardly to the light-outputting zone 2011 by the corresponding light-guiding dot 223. The supporting plate 24 comprises plural supporting plate openings 241. The plural supporting plate openings 241 are aligned with corresponding light-guiding dots 223 and corresponding light-outputting zones 2011. On the other hand, since the membrane switch circuit member 21 is made of the light-transmissible material, the plural light beams B can be transmitted through the membrane switch circuit member 21. Consequently, after the plural light beams B are guided by the light-guiding dots 223, the plural light beams B are sequentially transmitted through the plural supporting plate openings 241 and the membrane switch circuit member 21 and directed to the plural light-outputting zones 2011, thereby illuminating the character region or the symbol region of the keycap 201. Under this circumstance, the illuminating function is achieved.

While the plural light beams B are projected to the light guide plate 22, the plural light beams B are radiated from the light-emitting elements 232. Consequently, portions of the plural light beams B are introduced into the light guide plate 22 at a larger incident angle and unable to be subjected to total internal reflection within the light guide plate 22. The portions of the plural light beams B unable to be subjected to total internal reflection are transferred through the light guide plate 22 and projected upwardly. Under this circumstance, bright spots are usually generated at the locations near the light-emitting elements 232. The bright spots are also referred as bright bands or bright areas. The occurrence of the bright spots indicates that the light beams are very centralized and the illuminating efficacy is highly centralized. In other words, the luminous uniformity of the conventional luminous keyboard 2 is unsatisfied.

Therefore, there is a need of providing a luminous keyboard with enhanced luminous uniformity.

SUMMARY OF THE INVENTION

An object of the present invention provides a luminous keyboard with enhanced luminous uniformity.

In accordance with an aspect of the present invention, there is provided a luminous keyboard. The luminous keyboard includes a keypad module, at least one light-emitting element, a light guide plate and a reflecting plate. The keypad module is exposed to a top surface of the luminous keyboard. The at least one light-emitting element is disposed under the keypad module, and emits at least one light beam. The light guide plate is disposed under the keypad module. The at least one light beam is subjected to total internal reflection within the light guide plate and guided to the keypad module by the light guide plate. The reflecting plate is disposed over or under the light guide plate. A portion of the at least one light beam that is not subjected to total internal reflection within the light guide plate is reflected by the reflecting plate. The reflecting plate has at least one light amount control structure. The at least one light amount control structure is disposed on a top surface or a bottom surface of the reflecting plate and located near the corresponding light-emitting element. When the portion of the at least one light beam that is not subjected to total internal reflection within the light guide plate is transferred through the at least one light amount control structure, a reflected fraction of the at least one light beam is reduced by the at least one light amount control structure.

In accordance with another aspect of the present invention, there is provided a luminous keyboard. The luminous keyboard includes a keypad module, at least one light-emitting element, a light guide plate and a light absorption plate. The keypad module is exposed to a top surface of the luminous keyboard. The at least one light-emitting element is disposed under the keypad module, and emits at least one light beam. The light guide plate is disposed under the keypad module. The at least one light beam is subjected to total internal reflection within the light guide plate and guided to the keypad module by the light guide plate. The light absorption plate is disposed over or under the light guide plate. A portion of the at least one light beam that is not subjected to total internal reflection within the light guide plate is absorbed by the light absorption plate. The light absorption plate has at least one light amount control structure. The at least one light amount control structure is disposed on a top surface or a bottom surface of the light absorption plate and located near the corresponding light-emitting element. When the portion of the at least one light beam that is not subjected to total internal reflection within the light guide plate is transferred through the at least one light amount control structure, a reflected fraction of the at least one light beam is reduced by the at least one light amount control structure.

From the above descriptions, the present invention provides a luminous keyboard. The luminous keyboard has a reflecting plate (or a light absorption plate) with a special structure. In particular, plural light amount control structures with many variant examples are disposed on the reflecting plate (or the light absorption plate), and the light amount control structures are arranged between a light guide plate and the reflecting plate (or the light absorption plate). That is, the light amount control structures are located at the reflecting path of the light beams. When the portions of the light beams that are not subjected to total internal reflection within the light guide plate are reflected by the reflecting plate (or the light absorption plate), the reflected fraction of the light beams is reduced by the light amount control structure. Since the light beams are not very centralized, the problem of generating bright spots will be diminished. For further reducing the reflected fraction of the light beams, the light amount control structures of the luminous keyboard may have different lengths according to the practical requirements.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional luminous keyboard, the present invention provides an improved luminous keyboard.

Figure 1:
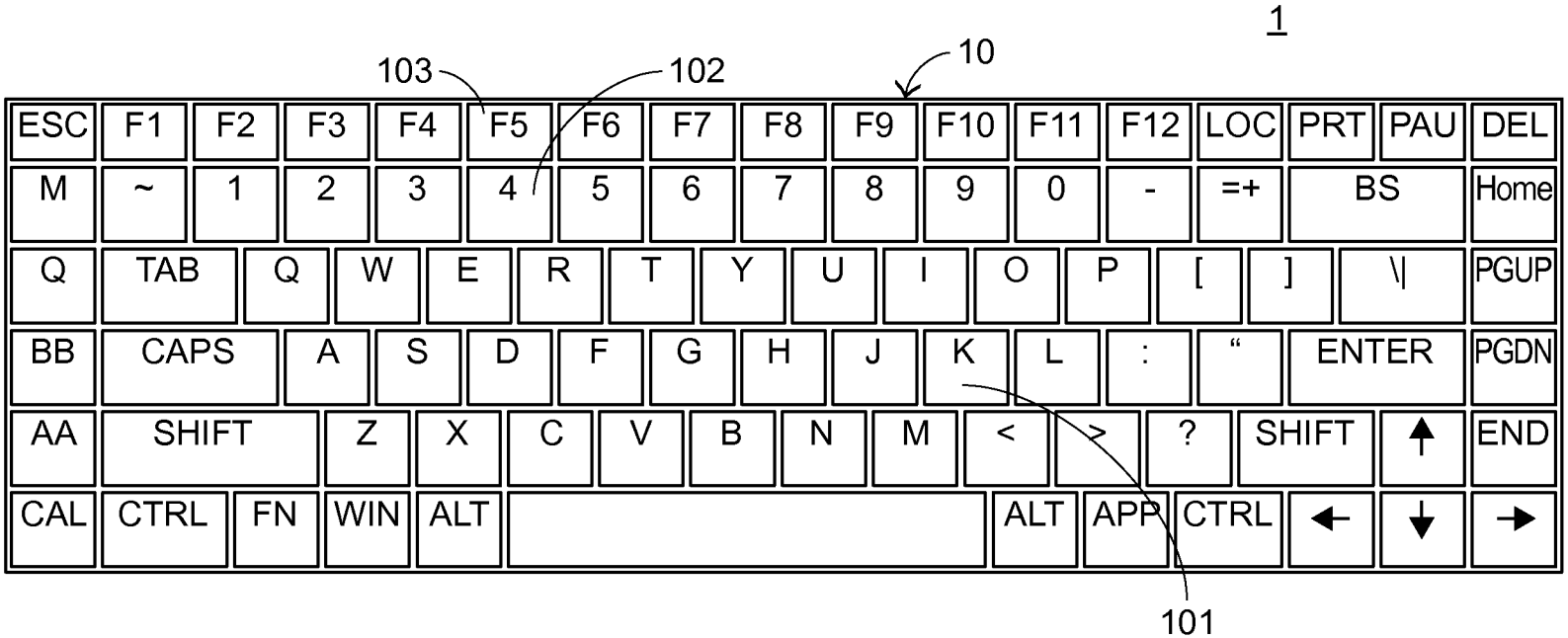
FIG.1 PRIOR ART
FIG. 1 is a schematic top view illustrating the outer appearance of a conventional keyboard.
Figure 2:
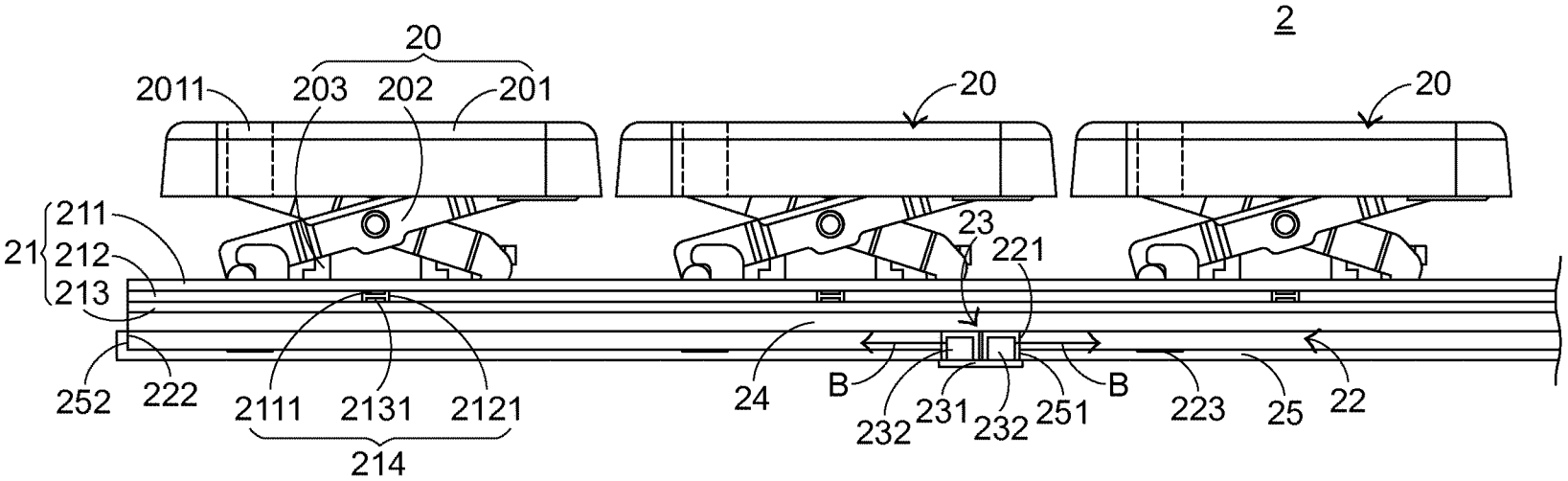
FIG.2 PRIOR ART
FIG. 2 is a schematic cross-sectional view illustrating a conventional luminous keyboard.
Figure 3:
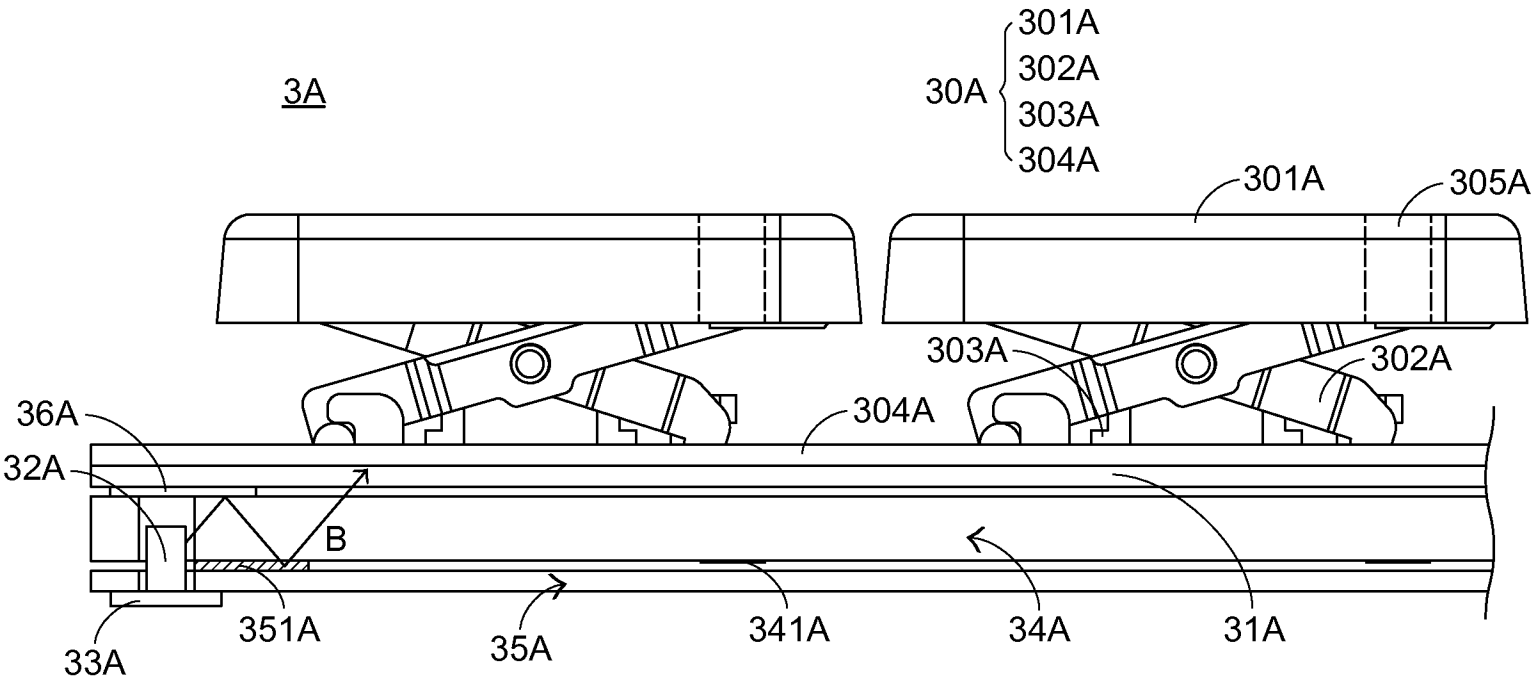
FIG. 3 is a schematic cross-sectional view illustrating the structure of a luminous keyboard according to a first embodiment of the present invention.

First of all, the structure of the luminous keyboard of the present invention will be illustrated as follows. FIG. 3 is a schematic cross-sectional view illustrating the structure of a luminous keyboard according to a first embodiment of the present invention. As shown in FIG. 3, the luminous keyboard 3A comprises a keypad module 30A, a supporting plate 31A, plural light-emitting elements 32A, an illumination circuit board 33A, a light guide plate 34A, a reflecting plate 35A and a light-shading plate 36A. For clarification and brevity, only one light-emitting element 32A is shown in the drawing. The keypad module 30A is exposed to a top surface of the luminous keyboard 3A. The keypad module 30A comprises plural keycaps 301A, plural connecting elements 302A, plural elastic elements 303A and a switch circuit member 304A. Each of the plural keycaps 301A, the corresponding connecting element 302A and the corresponding elastic element 303A are collaboratively defined as a key. Each keycap 301A has a light-outputting zone 305A. The plural keycaps 301A are exposed to the top surface of the luminous keyboard 3A, so that the keycaps 301A can be depressed by the user. The connecting elements 302A are used for connecting the corresponding keycaps 301A and the supporting plate 31A and allowing the keycaps 301A to be moved upwardly or downwardly relative to the supporting plate 31A. The elastic elements 303A are penetrated through the corresponding connecting elements 302A, and contacted with the corresponding keycaps 301A and the switch circuit member 304A. The switch circuit member 304A is disposed under the plural keys. When the switch circuit member 304A is triggered by the plural elastic elements 303A, plural key signals are correspondingly generated. The structure of the switch circuit member 304A is similar to that of the conventional membrane switch circuit member, and is not redundantly described herein. It is noted that the switch circuit member 304A is not limited to the membrane switch circuit member.

In this embodiment, the connecting element 302A is a scissors-type connecting element, and the elastic element 303A is a rubbery elastomer. Preferably but are not exclusively, the plural keycaps 301A of the plural keys are moved upwardly or downwardly with the connecting elements 302A, and the switch circuit member 304A is depressed by the plural elastic elements 303A through the plural keys. In another embodiment, the connecting elements are non-scissors connecting element for controlling movements of the keys. In a further embodiment, the keycaps are moved upwardly or downwardly in response to magnetic forces.

Please refer to FIG. 3 again. The plural light-emitting elements 32A are disposed on the illumination circuit board 33A, and disposed under the keypad module 30A. Moreover, the plural light-emitting elements 32A are partially inserted into the light guide plate 34A. The plural light-emitting elements 32A are used for emitting plural light beams B, and the plural light beams B are laterally introduced into the light guide plate 34A. The light guide plate 34A is disposed under the keypad module 30A. The plural light beams B are subjected to total internal reflection within the light guide plate 34A, and thus the plural light beams B are guided to the keypad module 30A by the light guide plate 34A. The light guide plate 34A comprises plural light-guiding structures 341A. Each light-guiding structure 341A is aligned with the corresponding light-outputting zone 305A. The plural light beams B can be guided to the corresponding light-outputting zones 305A by the light-guiding structures 341A so as to illuminate the corresponding keys. In this embodiment, the plural light-emitting elements 32A are side-view light emitting diodes, and the illumination circuit board 33A is a flexible printed circuit (FPC). In an embodiment, the light-guiding structure 341A is a one of a light-guiding microstructure, a light-guiding dot, a light-guiding ink and a light-guiding texturing structure.

The reflecting plate 35A is disposed under the light guide plate 34A. The portions of the plural light beams B that are not subjected to total internal reflection within the light guide plate 34A can be reflected by the reflecting plate 35A. Consequently, the utilization efficiency of the portions of the plural light beams B that are not subjected to total internal reflection will be enhanced. Moreover, the reflecting plate 35A comprises plural light amount control structures 351A corresponding to the plural light-emitting elements 32A. For brevity, only one light amount control structure 351A is shown in the drawing. The light amount control structures 351A are disposed on a top surface of the reflecting plate 35A, and located near the corresponding light-emitting elements 32A. That is, the plural light amount control structures 351A are arranged between the reflecting plate 35A and the light guide plate 34A, and located at specified regions near the corresponding light-emitting elements 32A. After the portions of the plural light beams B that are not subjected to total internal reflection within the light guide plate 34A are transferred through the light amount control structures 351A, the reflected fraction of the light beams B is reduced.

The light-shading plate 36A is disposed over the light guide plate 34A and the plural light-emitting elements 32A. By means of the light-shading plate 36A, the portions of the plural light beams B that are not subjected to total internal reflection within the light guide plate 34A will not be directly projected to the keypad module 30A.

In this embodiment, the plural light amount control structures 351A are made of light absorption material. Preferably, the light absorption material is a composite material of a high refractive index material and a low refractive index material, wherein the low refractive index material is covered by the high refractive index material. Alternatively, the light absorption material is selected from a surface plasmon material or a metamaterial.

The operating principles of depressing the keycaps 301A of the luminous keyboard 3A to generate the key signals are well known to those skilled in the art, and are not redundantly described herein. The illumination of the luminous keyboard 3A will be illustrated as follows. Please refer to FIG. 3 again. When the plural light-emitting elements 32A emit the plural light beams B, portions of the light beams B are laterally introduced into the light guide plate 34A and subjected to total internal reflection within the light guide plate 34A. The light beams B can be guided to the corresponding light-outputting zones 305A by the light-guiding structures 341A so as to illuminate the light-outputting zones 305A. On the other hand, other portions of the plural light beams B are laterally introduced into the light guide plate 34A at a larger incident angle and unable to be subjected to total internal reflection within the light guide plate 34A, and thus shaded by the light-shading plate 36A and reflected to the light guide plate 34A. The portions of the plural light beams B reflected by the second reflecting plate 36A are transmitted through the light guide plate 34A, and then transferred through the light amount control structures 351A.

When the light beams B are transferred through the light amount control structures 351A, portions of the light beams B are absorbed by the light amount control structures 351A. The remaining small portions of the light beams B are transmitted through the light amount control structures 351A and reflected to the light guide plate 34A by the underlying reflecting plate 35A, and no longer shaded by the light-shading plate 36A. Consequently, the remaining small portions of the light beams B are projected to the keycaps 301A and not directly projected to the light-outputting zones 305A. Since portions of the light beams B at the larger incident angle are absorbed by the light amount control structures 351A, only the remaining small portions of the light beams B are reflected to the keycaps 301A. Since the light beams are not very centralized, the problem of generating bright spots will be diminished. Under this circumstance, the luminous uniformity is enhanced.

Figure 4:
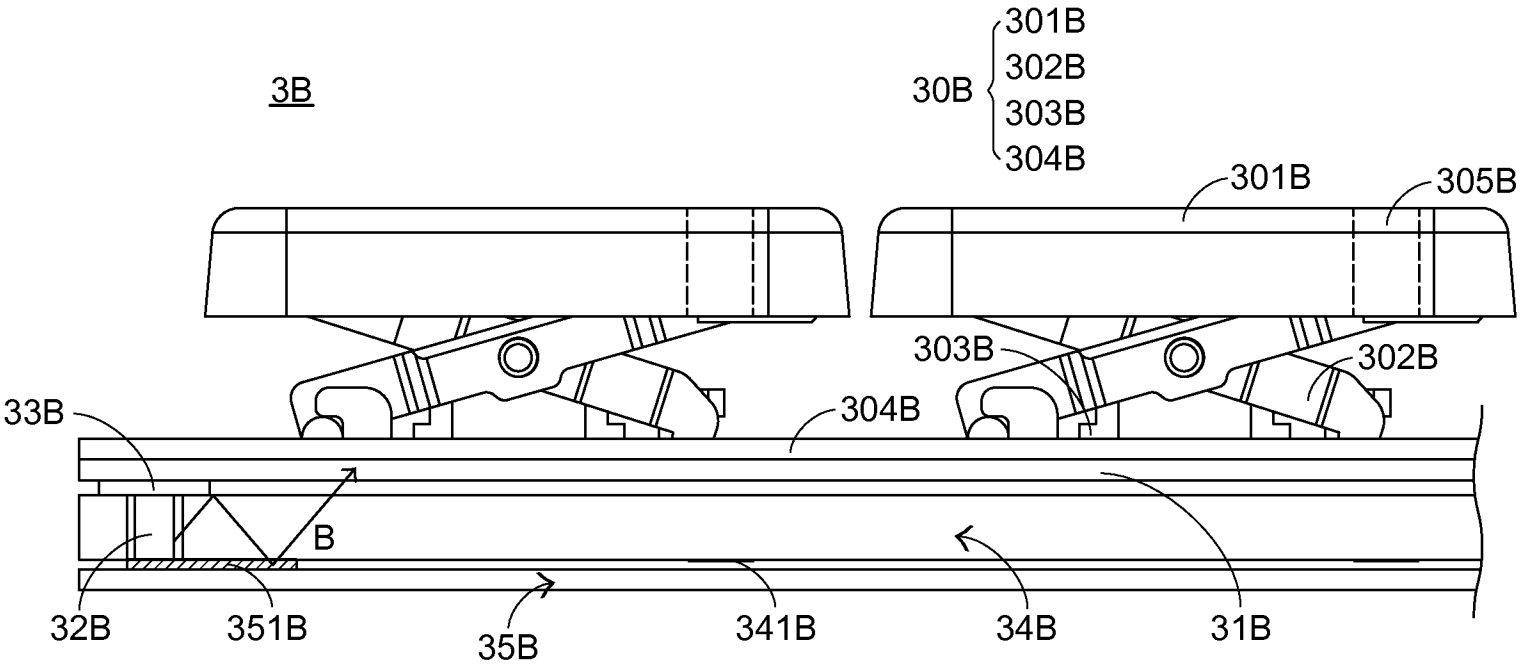
FIG. 4 is a schematic cross-sectional view illustrating the structure of a luminous keyboard according to a second embodiment of the present invention.

The present invention further provides a luminous keyboard of a second embodiment, which is distinguished from the above embodiment. FIG. 4 is a schematic cross-sectional view illustrating the structure of a luminous keyboard according to a second embodiment of the present invention. As shown in FIG. 4, the luminous keyboard 3B comprises a keypad module 30B, a supporting plate 31B, plural light-emitting elements 32B, an illumination circuit board 33B, a light guide plate 34B and a reflecting plate 35B. For clarification and brevity, only one light-emitting element 32B is shown in the drawing. The keypad module 30B comprises plural keycaps 301B, plural connecting elements 302B, plural elastic elements 303B and a switch circuit member 304B. Each keycap 301B has a light-outputting zone 305B. The light guide plate 34B comprises plural light-guiding structures 341B. Each light-guiding structure 341B is aligned with the corresponding light-outputting zone 305B. Moreover, the reflecting plate 35B comprises plural light amount control structures 351B corresponding to the plural light-emitting elements 32B. For brevity, only one light amount control structure 351B is shown in the drawing. The components of the luminous keyboard 3B of this embodiment which are similar to the luminous keyboard 3A of the first embodiment are not redundantly described herein. In comparison with the first embodiment, the luminous keyboard 3B of this embodiment is not equipped with the light-shading plate and the arrangements of the light-emitting elements 32B and the illumination circuit board 33B are distinguished.

In the embodiment of FIG. 4, the light-emitting elements 32B are inverted, and inserted into the light guide plate 34B through an upper portion of the light guide plate 34B. In addition, the illumination circuit board 33B supporting the light-emitting elements 32B is also inverted and arranged between the supporting plate 31B and the light guide plate 34B. Since the illumination circuit board 33B is disposed over the light guide plate 34B, the illumination circuit board 33B also has the function of shading the light beams B. Consequently, the luminous keyboard 3B of this embodiment is not equipped with the light-shading plate. That is, the overall thickness of the luminous keyboard 3B is reduced, and the fabricating cost of the luminous keyboard 3B is reduced to meet the economic benefit. The illumination of the luminous keyboard 3B is similar to the illumination of the luminous keyboard 3A of the first embodiment, and is not redundantly described herein.

Figure 5:
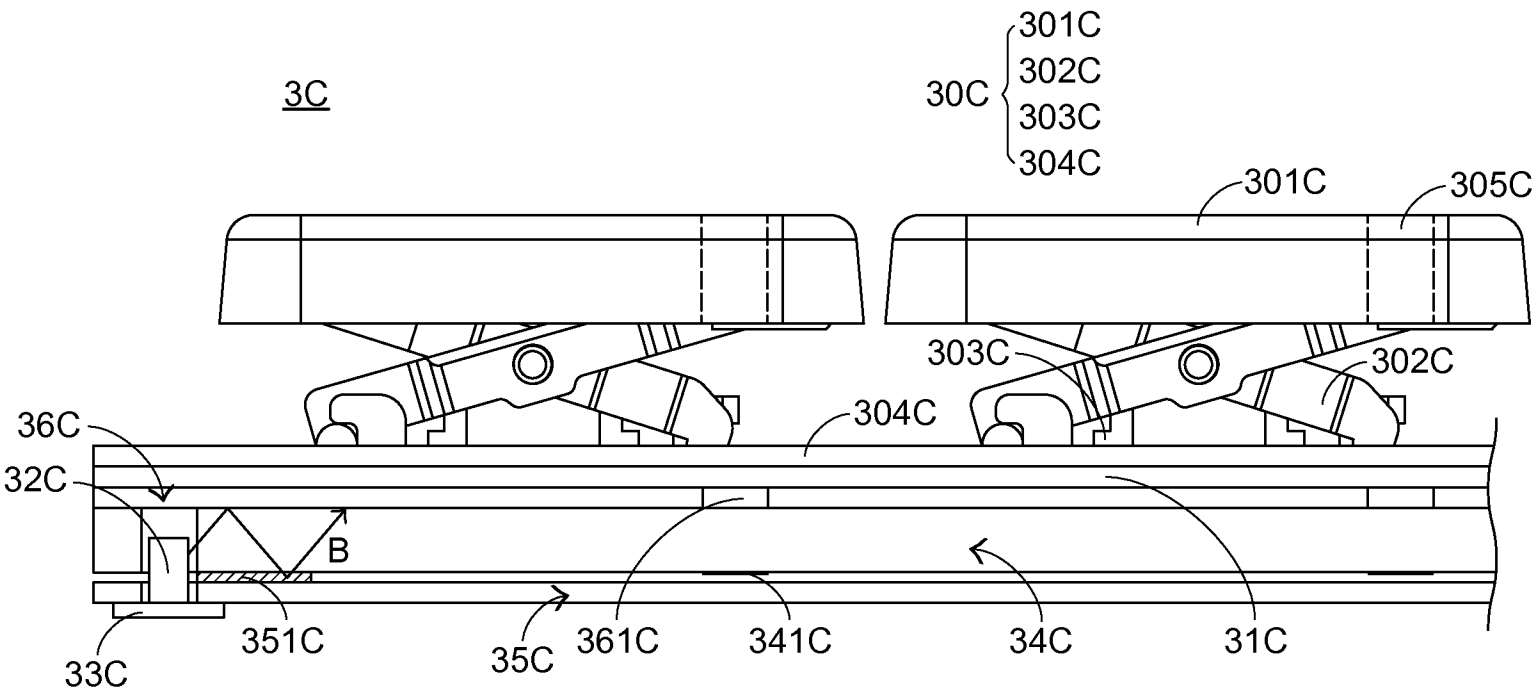
FIG. 5 is a schematic cross-sectional view illustrating the structure of a luminous keyboard according to a third embodiment of the present invention.

The present invention further provides a luminous keyboard of a third embodiment, which is distinguished from the above embodiments. FIG. 5 is a schematic cross-sectional view illustrating the structure of a luminous keyboard according to a third embodiment of the present invention. As shown in FIG. 5, the luminous keyboard 3C comprises a keypad module 30C, a supporting plate 31C, plural light-emitting elements 32C, an illumination circuit board 33C, a light guide plate 34C, a first reflecting plate 35C and a second reflecting plate 36C. For clarification and brevity, only one light-emitting element 32C is shown in the drawing. The keypad module 30C comprises plural keycaps 301C, plural connecting elements 302C, plural elastic elements 303C and a switch circuit member 304C. Each keycap 301C has a light-outputting zone 305C. The light guide plate 34C comprises plural light-guiding structures 341C. Each light-guiding structure 341C is aligned with the corresponding light-outputting zone 305C. Moreover, the first reflecting plate 35C comprises plural light amount control structures 351C corresponding to the plural light-emitting elements 32C. For brevity, only one light amount control structure 351C is shown in the drawing. The components of the luminous keyboard 3C of this embodiment which are similar to the luminous keyboard 3A of the first embodiment are not redundantly described herein. In comparison with the first embodiment, the luminous keyboard 3C of this embodiment is not equipped with the light-shading plate, and the luminous keyboard 3C further comprises the second reflecting plate 36C in replace of the light-shading plate.

The second reflecting plate 36C is disposed over the light guide plate 34C. That is, the second reflecting plate 36C and the first reflecting plate 35C are respectively disposed over and under the light guide plate 34C. The portions of the plural light beams B that are not subjected to total internal reflection within the light guide plate 34C are reflected by the first reflecting plate 35C and the second reflecting plate 36C. The second reflecting plate 36C further comprises plural openings 361C. Each opening 361C is aligned with the corresponding light-outputting zone 305C. Since the second reflecting plate 36C has the functions of shading and reflecting the light beams B, the luminous keyboard 3C of this embodiment is not equipped with the light-shading plate.

The illumination of the luminous keyboard 3C will be illustrated as follows. Please refer to FIG. 5 again. When the plural light-emitting elements 32C emit the plural light beams B, portions of the light beams B are laterally introduced into the light guide plate 34C and subjected to total internal reflection within the light guide plate 34C. The light beams B can be guided to the corresponding light-outputting zones 305C by the light-guiding structures 341C so as to illuminate the light-outputting zones 305C. On the other hand, other portions of the plural light beams B are laterally introduced into the light guide plate 34C at a larger incident angle and unable to be subjected to total internal reflection within the light guide plate 34C, and thus reflected to the light guide plate 34C by the second reflecting plate 36C. The portions of the plural light beams B reflected by the second reflecting plate 36C are transmitted through the light guide plate 34C, and then transferred through the light amount control structures 351C. When the light beams B are transferred through the light amount control structures 351C, portions of the light beams B are absorbed by the light amount control structures 351C. The remaining small portions of the light beams B are transmitted through the light amount control structure 351C and reflected by the underlying first reflecting plate 35C.

Then, the remaining small portions of the light beams B are alternately reflected by the first reflecting plate 35C and the second reflecting plate 36C. Since portions of the light beams B are absorbed by the light amount control structures 351C during the reflecting process, only the remaining small portions of the light beams B are projected to the keycaps 301C through the openings 361C. Since the light beams B are alternately reflected by the overlying second reflecting plate 36C and the underlying first reflecting plate 35C of the light guide plate 34D and the light amount control structures 351C are located at the reflection path of the light beams B, the reflected fraction of the light beams B is reduced. Since the light beams are not very centralized, the problem of generating bright spots will be diminished.

Figure 6:
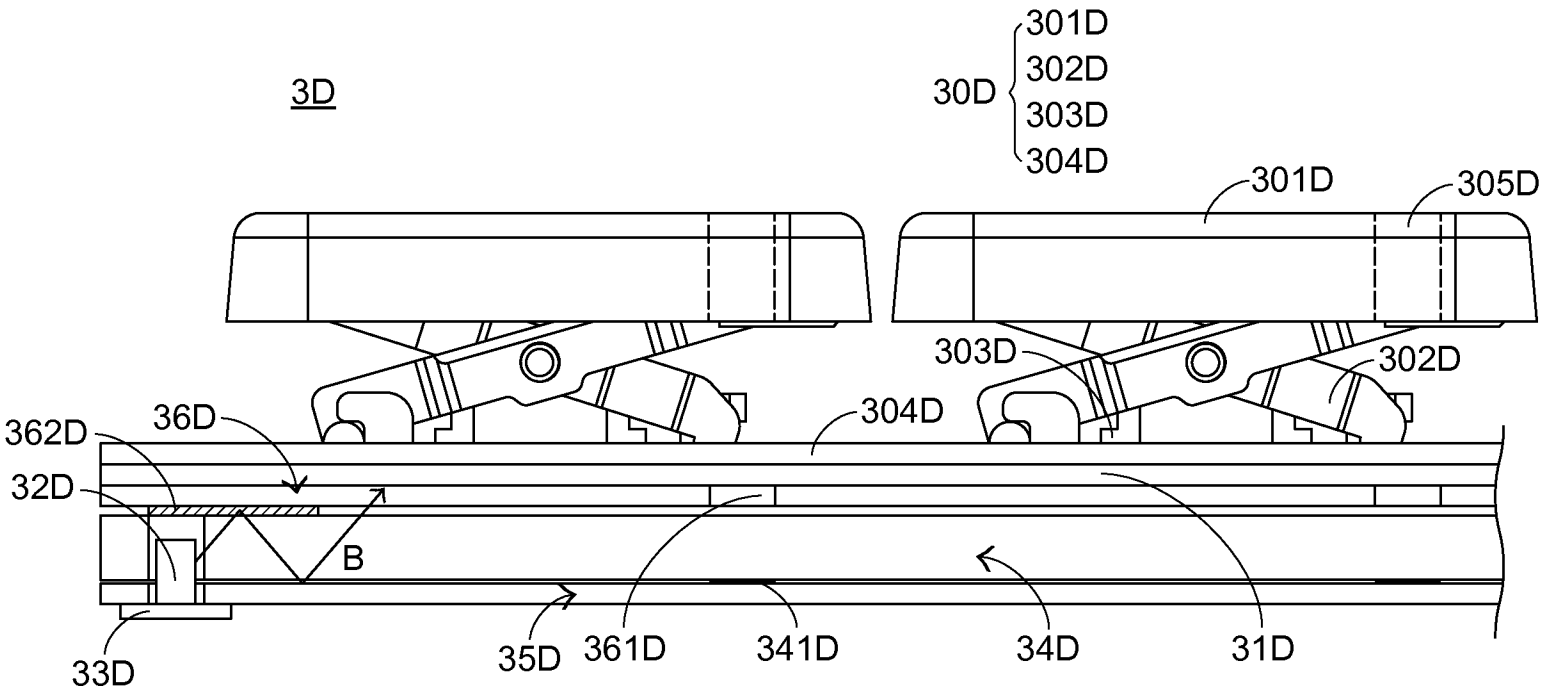
FIG. 6 is a schematic cross-sectional view illustrating the structure of a luminous keyboard according to a fourth embodiment of the present invention.

The present invention further provides a luminous keyboard of a fourth embodiment, which is distinguished from the above embodiments. FIG. 6 is a schematic cross-sectional view illustrating the structure of a luminous keyboard according to a fourth embodiment of the present invention. As shown in FIG. 6, the luminous keyboard 3D comprises a keypad module 30D, a supporting plate 31D, plural light-emitting elements 32D, an illumination circuit board 33D, a light guide plate 34D, a first reflecting plate 35D and a second reflecting plate 36D. For clarification and brevity, only one light-emitting element 32D is shown in the drawing. The keypad module 30D comprises plural keycaps 301D, plural connecting elements 302D, plural elastic elements 303D and a switch circuit member 304D. Each keycap 301D has a light-outputting zone 305D. The light guide plate 34D comprises plural light-guiding structures 341D. Each light-guiding structure 341D is aligned with the corresponding light-outputting zone 305D. The second reflecting plate 36D further comprises plural openings 361D. Each opening 361D is aligned with the corresponding light-outputting zone 305D. The components of the luminous keyboard 3D of this embodiment which are similar to the luminous keyboard 3C of the third embodiment are not redundantly described herein. In comparison with the third embodiment, the first reflecting plate 35D of the luminous keyboard 3D is not equipped with the light amount control structures. Whereas, the second reflecting plate 36D comprises plural light amount control structures 362D. For brevity, only one light amount control structure 362D is shown in the drawing.

The structures of the luminous keyboard 3D of this embodiment are somewhat different from the structures of the luminous keyboard 3C of the third embodiment. However, the plural light amount control structures 362D are arranged between the second reflecting plate 36D and the light guide plate 34D and located near the plural light-emitting elements 32D. That is, the light amount control structures 362D are still located at the reflection path of the light beams B that are alternately reflected by the first reflecting plate 35D and the second reflecting plate 36D. Consequently, the luminous uniformity of the luminous keyboard 3D is also enhanced. The illumination of the luminous keyboard 3D is similar to the illumination of the luminous keyboard 3C of the third embodiment, and is not redundantly described herein.

Figure 7:
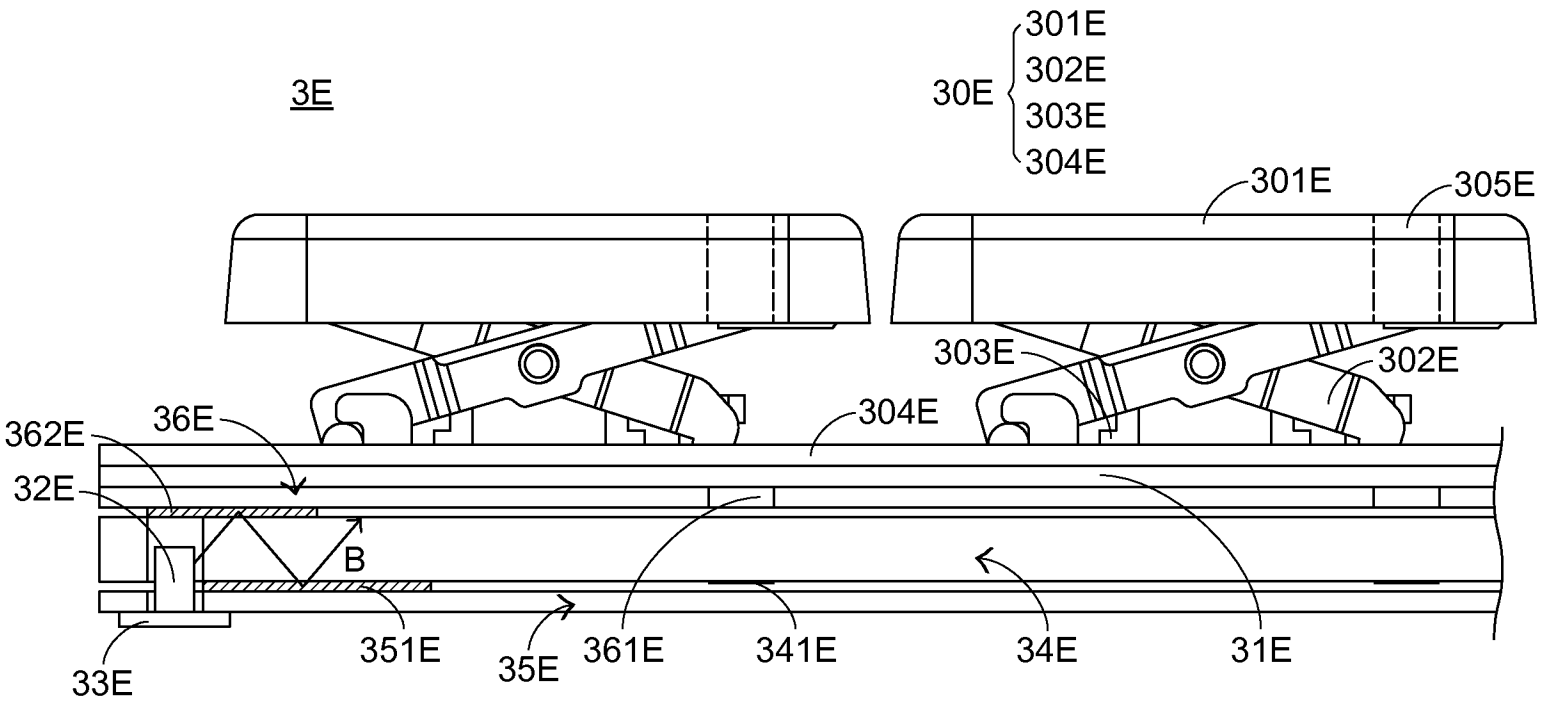
FIG. 7 is a schematic cross-sectional view illustrating the structure of a luminous keyboard according to a fifth embodiment of the present invention.

The present invention further provides a luminous keyboard of a fifth embodiment, which is distinguished from the above embodiments. FIG. 7 is a schematic cross-sectional view illustrating the structure of a luminous keyboard according to a fifth embodiment of the present invention. As shown in FIG. 7, the luminous keyboard 3E comprises a keypad module 30E, a supporting plate 31E, plural light-emitting elements 32E, an illumination circuit board 33E, a light guide plate 34E, a first reflecting plate 35E and a second reflecting plate 36E. For clarification and brevity, only one light-emitting element 32E is shown in the drawing. The keypad module 30E comprises plural keycaps 301E, plural connecting elements 302E, plural elastic elements 303E and a switch circuit member 304E. Each keycap 301E has a light-outputting zone 305E. The light guide plate 34E comprises plural light-guiding structures 341E. Each light-guiding structure 341E is aligned with the corresponding light-outputting zone 305E. The second reflecting plate 36E further comprises plural openings 361E. Each opening 361E is aligned with the corresponding light-outputting zone 305E. The components of the luminous keyboard 3E of this embodiment which are similar to the luminous keyboard 3C of the third embodiment are not redundantly described herein. In comparison with the third embodiment, the second reflecting plate 36E of the luminous keyboard 3E comprises plural second light amount control structures 362E (only one is shown in the drawing), and the first reflecting plate 35E comprises plural first light amount control structures 351E (only one is shown in the drawing).

Please refer to FIG. 7 again. The plural first light amount control structures 351E are arranged between the first reflecting plate 35E and the light guide plate 34E. That is, the first light amount control structures 351E are disposed on a top surface of the first reflecting plate 35E, and located at specified regions near the corresponding light-emitting elements 32E. The plural second light amount control structures 362E are arranged between the second reflecting plate 36E and the light guide plate 34E. That is, the second light amount control structures 362E are disposed on a bottom surface of the second reflecting plate 36E, and located at specified regions near the corresponding light-emitting elements 32E.

Figure 8:
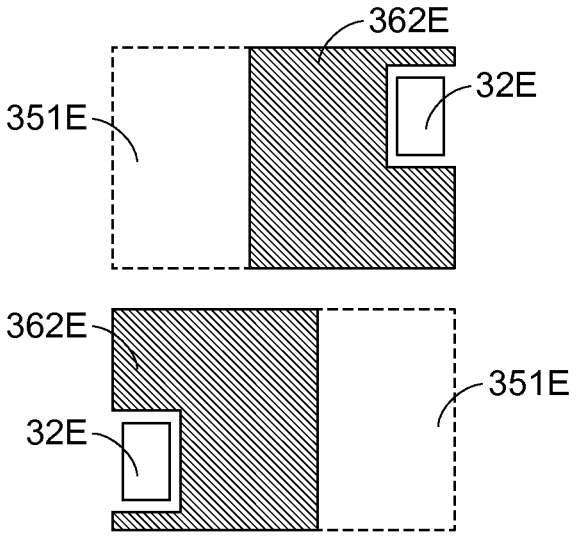
FIG. 8 is a schematic top view illustrating a portion of the luminous keyboard of the fifth embodiment.

Please refer to FIGS. 7 and 8. FIG. 8 is a schematic top view illustrating a portion of the luminous keyboard of the fifth embodiment. In FIG. 8, the light-emitting elements 32E, the first light amount control structures 351E and the second light amount control structures 362E are shown. The first light amount control structures 351E are overlapped with the corresponding second light amount control structures 362E. The first light amount control structures 351E are longer than the corresponding second light amount control structures 362E. Moreover, the first light amount control structures 351E and the second light amount control structures 362E are asymmetrical structures. In FIG. 8, two light-emitting elements 32E are shown. Since two light-emitting elements 32E emit the light beams, the area between the two light-emitting elements 32E has higher light amount of the light beams B. In this embodiment, the first light amount control structures 351E and the second light amount control structures 362E at the area between the two light-emitting elements 32E have stronger light-absorption capability. Moreover, the first light amount control structures 351E and the second light amount control structures 362E are asymmetrical structures. In other words, the wider part of the first light amount control structure 351E and the wider part of the adjacent second light amount control structures 362E are located at the area between the two light-emitting elements 32E in order to absorb more light amount of the light beams B. Consequently, the problem of generating bright spots will be diminished.

Figure 9:
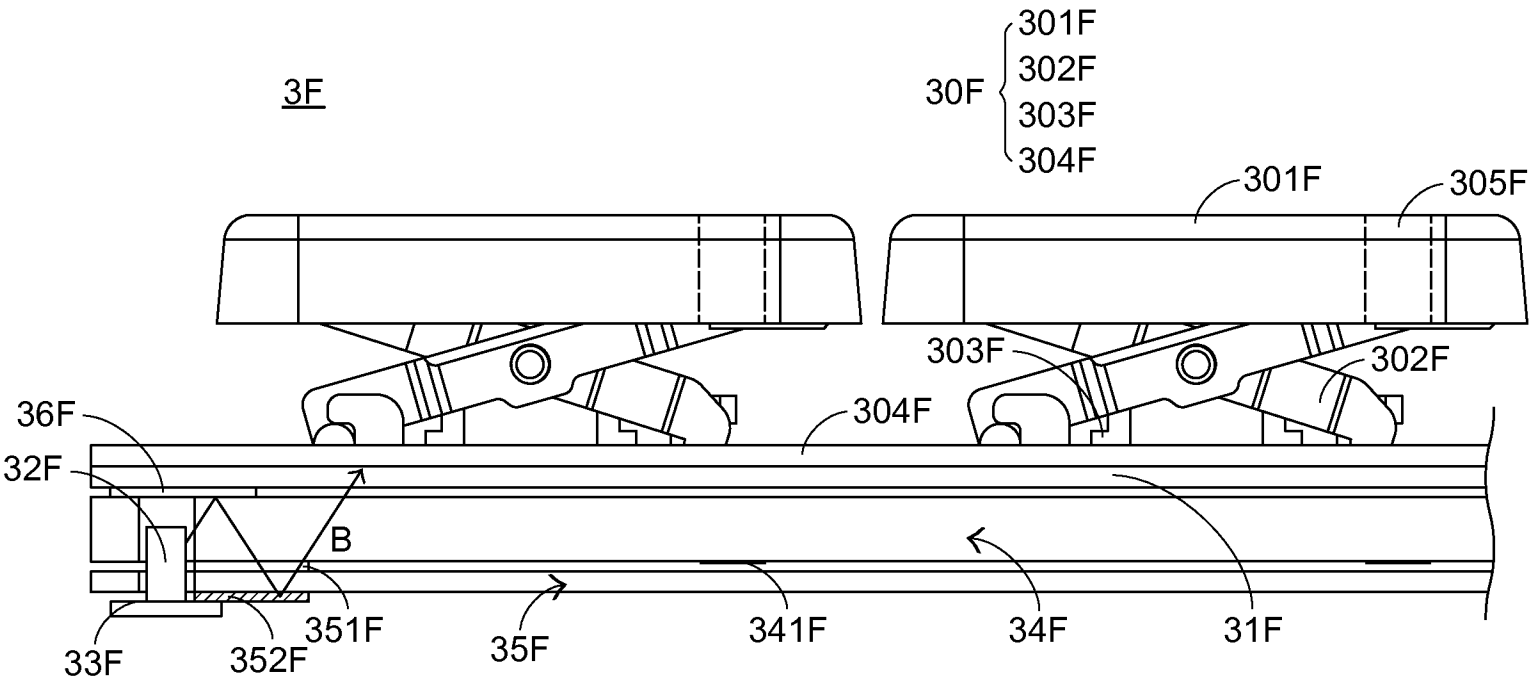
FIG. 9 is a schematic cross-sectional view illustrating the structure of a luminous keyboard according to a sixth embodiment of the present invention.

The present invention further provides a luminous keyboard of a sixth embodiment, which is distinguished from the above embodiments. FIG. 9 is a schematic cross-sectional view illustrating the structure of a luminous keyboard according to a sixth embodiment of the present invention. As shown in FIG. 9, the luminous keyboard 3F comprises a keypad module 30F, a supporting plate 31F, plural light-emitting elements 32F, an illumination circuit board 33F, a light guide plate 34F, a reflecting plate 35F, a light-shading plate 36F and plural light absorption structures 37F. For clarification and brevity, only one light-emitting element 32F and one light absorption structure 37F are shown in the drawing. The keypad module 30F comprises plural keycaps 301F, plural connecting elements 302F, plural elastic elements 303F and a switch circuit member 304F. Each keycap 301F has a light-outputting zone 305F. The light guide plate 34F comprises plural light-guiding structures 341F. Each light-guiding structure 341F is aligned with the corresponding light-outputting zone 305F. Moreover, the reflecting plate 35F comprises plural light amount control structures 351F corresponding to the plural light-emitting elements 32F. For brevity, only one light amount control structure 351F is shown in the drawing. The components of the luminous keyboard 3F of this embodiment which are similar to the luminous keyboard 3A of the first embodiment are not redundantly described herein. In comparison with the first embodiment, the following two aspects of the luminous keyboard 3F of this embodiment are distinguished. Firstly, the plural light amount control structures 351F of the luminous keyboard 3F are made of anti-reflection materials, and the plural light amount control structures 351F are deposited on a top surface of the reflecting plate 35F. Secondly, the luminous keyboard 3F of this embodiment further comprises the plural light absorption structures 37F.

The operating principles of the anti-reflection material will be described as follows. When the light beams transferred from a first transparent object to a second transparent object with a different refractive index, the light beams are reflected by the interface between the first object and the second object. In case that the difference between the refractive indexes of these two objects is higher, the intensity of the reflective light beams is stronger. For achieving the anti-reflecting function, the material with the refractive index close to air is selected as the anti-reflection material. In an embodiment, the anti-reflection material is magnesium fluoride (MgF2), silicon dioxide (SiO2), Teflon, or any other appropriate material.

The plural light amount control structures 351F are not used for absorbing the light beams B. When the light beams B are projected on the plural light amount control structures 351F, greater portions of the light beams B are transmitted through the plural light amount control structures 351F, and only smaller portions of the light beams are reflected. Consequently, the reflected fraction of the light beams B is reduced. In this embodiment, the light absorption structures 37F are disposed on the reflecting plate 35F. Moreover, the light absorption structures 37F and the light amount control structures 351F are disposed on opposite surfaces of the reflecting plate 35F. That is, the light absorption structures 37F are disposed on a bottom surface of the reflecting plate 35F. Consequently, the greater portions of the light beams B introduced into the light amount control structures 351F will be absorbed by the light absorption structure 37F. Consequently, the amount of the light beams reflected by the reflecting plate 35F is further reduced.

Figure 10:
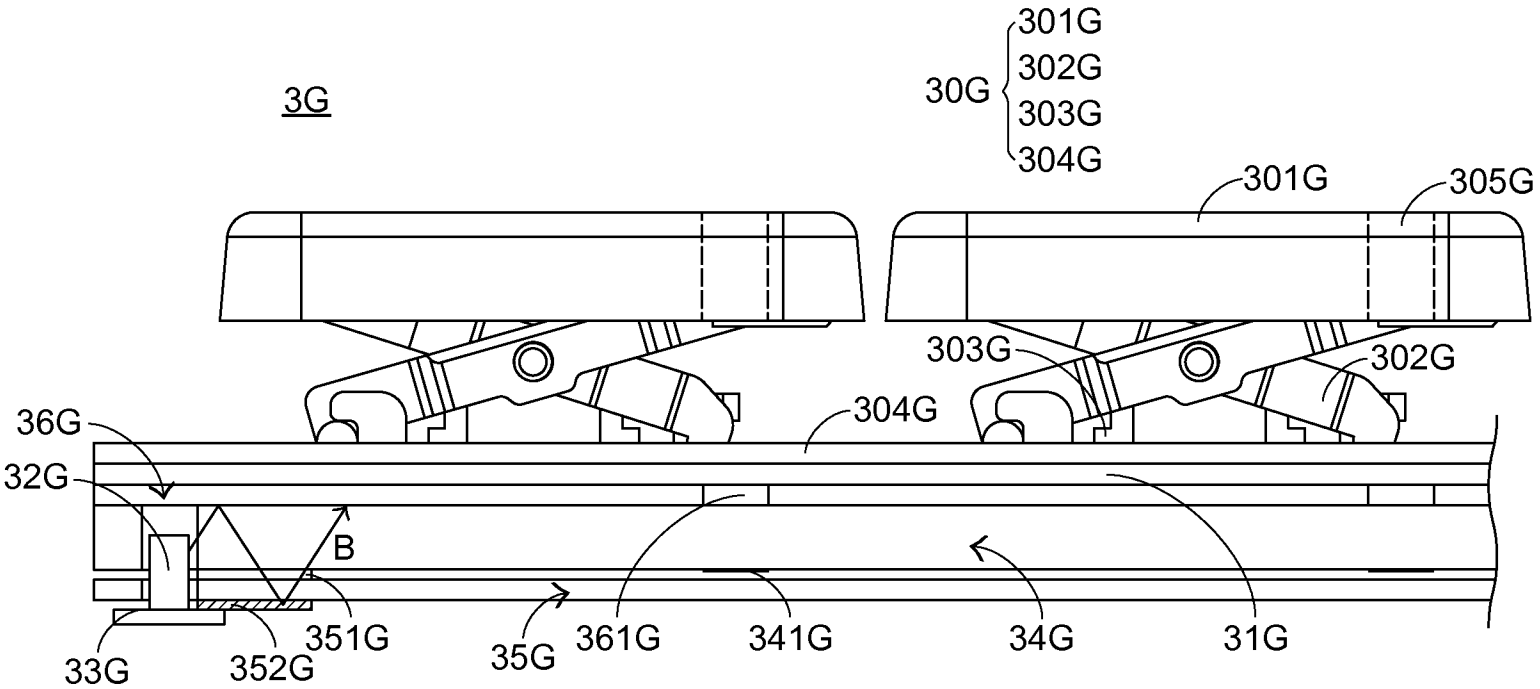
FIG. 10 is a schematic cross-sectional view illustrating the structure of a luminous keyboard according to a seventh embodiment of the present invention.

The present invention further provides a luminous keyboard of a seventh embodiment, which is distinguished from the above embodiments. FIG. 10 is a schematic cross-sectional view illustrating the structure of a luminous keyboard according to a seventh embodiment of the present invention. As shown in FIG. 10, the luminous keyboard 3G comprises a keypad module 30G, a supporting plate 31G, plural light-emitting elements 32G, an illumination circuit board 33G, a light guide plate 34G, a first reflecting plate 35G, a second reflecting plate 36G and plural light absorption structures 37G. For clarification and brevity, only one light-emitting element 32G is shown in the drawing. The keypad module 30G comprises plural keycaps 301G, plural connecting elements 302G, plural elastic elements 303G and a switch circuit member 304G. Each keycap 301G has a light-outputting zone 305G. The light guide plate 34G comprises plural light-guiding structures 341G. Each light-guiding structure 341G is aligned with the corresponding light-outputting zone 305G. The second reflecting plate 36G further comprises plural openings 361G. Each opening 361G is aligned with the corresponding light-outputting zone 305G. Moreover, the first reflecting plate 35G comprises plural light amount control structures 351G corresponding to the plural light-emitting elements 32G. For brevity, only one light amount control structure 351G is shown in the drawing. The components of the luminous keyboard 3G of this embodiment which are similar to the luminous keyboard 3F of the sixth embodiment are not redundantly described herein. In comparison with the sixth embodiment, the luminous keyboard 3G of this embodiment is not equipped with the light-shading plate, and the luminous keyboard 3G further comprises the second reflecting plate 36G in replace of the light-shading plate.

The second reflecting plate 36G is disposed over the light guide plate 34G. That is, the second reflecting plate 36G and the first reflecting plate 35G are respectively disposed over and under the light guide plate 34G. The portions of the plural light beams B that are not subjected to total internal reflection within the light guide plate 34G are reflected by the first reflecting plate 35G and the second reflecting plate 36G. The second reflecting plate 36G further comprises plural openings 361G. Each opening 361G is aligned with the corresponding light-outputting zone 305G. Since the second reflecting plate 36G has the functions of shading and reflecting the light beams B, the luminous keyboard 3G of this embodiment is not equipped with the light-shading plate.

The structure of the luminous keyboard 3G of this embodiment may be modified. For example, in a variant example, plural light amount control structures are disposed on a bottom surface of the second reflecting plate, and plural light absorption structures are disposed on a top surface of the second reflecting plate. In another variant example, the plural light-emitting elements and the illumination circuit board are inverted. By changing the locations of some components, different stack structures of the luminous keyboard can be produced. These stack structures can diminish the problem of generating bright spots.

Figure 11:
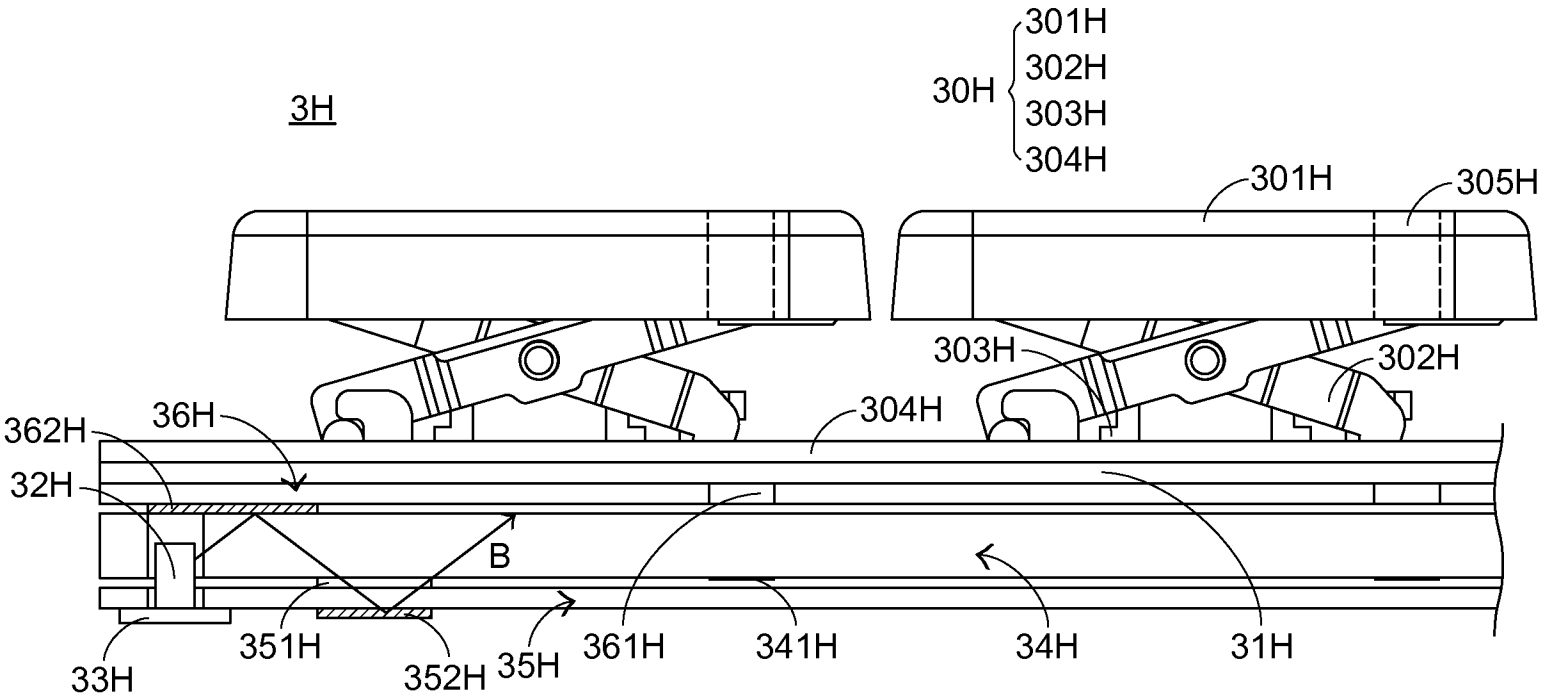
FIG. 11 is a schematic cross-sectional view illustrating the structure of a luminous keyboard according to an eighth embodiment of the present invention.

The present invention further provides a luminous keyboard of an eighth embodiment, which is distinguished from the above embodiments. FIG. 11 is a schematic cross-sectional view illustrating the structure of a luminous keyboard according to an eighth embodiment of the present invention. As shown in FIG. 11, the luminous keyboard 3H comprises a keypad module 30H, a supporting plate 31H, plural light-emitting elements 32H, an illumination circuit board 33H, a light guide plate 34H, a first reflecting plate 35H, a second reflecting plate 36H and plural light absorption structures 37H. For clarification and brevity, only one light-emitting element 32H is shown in the drawing. The keypad module 30H comprises plural keycaps 301H, plural connecting elements 302H, plural elastic elements 303H and a switch circuit member 304H. Each keycap 301H has a light-outputting zone 305H. The light guide plate 34H comprises plural light-guiding structures 341H. Each light-guiding structure 341H is aligned with the corresponding light-outputting zone 305H. The second reflecting plate 36H further comprises plural openings 361H. Each opening 361H is aligned with the corresponding light-outputting zone 305H. The components of the luminous keyboard 3H of this embodiment which are similar to the luminous keyboard 3G of the seventh embodiment are not redundantly described herein. In comparison with the seventh embodiment, the first reflecting plate 35H comprises plural first light amount control structures 351H (only one is shown in the drawing), and the second reflecting plate 36H of the luminous keyboard 3H comprises plural second light amount control structures 362H (only one is shown in the drawing).

Please refer to FIG. 11 again. The plural first light amount control structures 351H are arranged between the first reflecting plate 35H and the light guide plate 34H. That is, the first light amount control structures 351H are disposed on a top surface of the first reflecting plate 35H, and located at specified regions near the corresponding light-emitting elements 32H. The plural second light amount control structures 362H are arranged between the second reflecting plate 36H and the light guide plate 34H. That is, the second light amount control structures 362H are disposed on a bottom surface of the second reflecting plate 36H, and located at specified regions near the corresponding light-emitting elements 32H.

Figure 12:
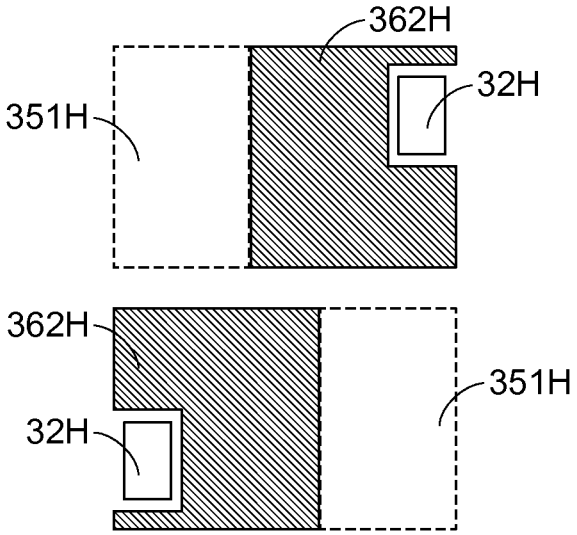
FIG. 12 is a schematic top view illustrating a portion of the luminous keyboard of the eighth embodiment.

Please refer to FIGS. 11 and 12. FIG. 12 is a schematic top view illustrating a portion of the luminous keyboard of the eighth embodiment. In FIG. 12, the light-emitting elements 32H, the first light amount control structures 351H and the second light amount control structures 362H are shown. The first light amount control structures 351H are not overlapped with the corresponding second light amount control structures 362H. Moreover, the first light amount control structures 351H and the second light amount control structures 362H are asymmetrical structures. In FIG. 12, two light-emitting elements 32H are shown. Since two light-emitting elements 32H emit the light beams, the area between the two light-emitting elements 32H has higher light amount of the light beams B. In this embodiment, the first light amount control structures 351H and the second light amount control structures 362H at the area between the two light-emitting elements 32H have stronger light-absorption capability. Moreover, the first light amount control structures 351H and the second light amount control structures 362H are asymmetrical structures. In other words, the wider part of the first light amount control structure 351E and the wider part of the adjacent second light amount control structures 362E are located at the area between the two light-emitting elements 32H in order to absorb more light amount of the light beams B. Consequently, the problem of generating bright spots will be diminished.

Figure 13:
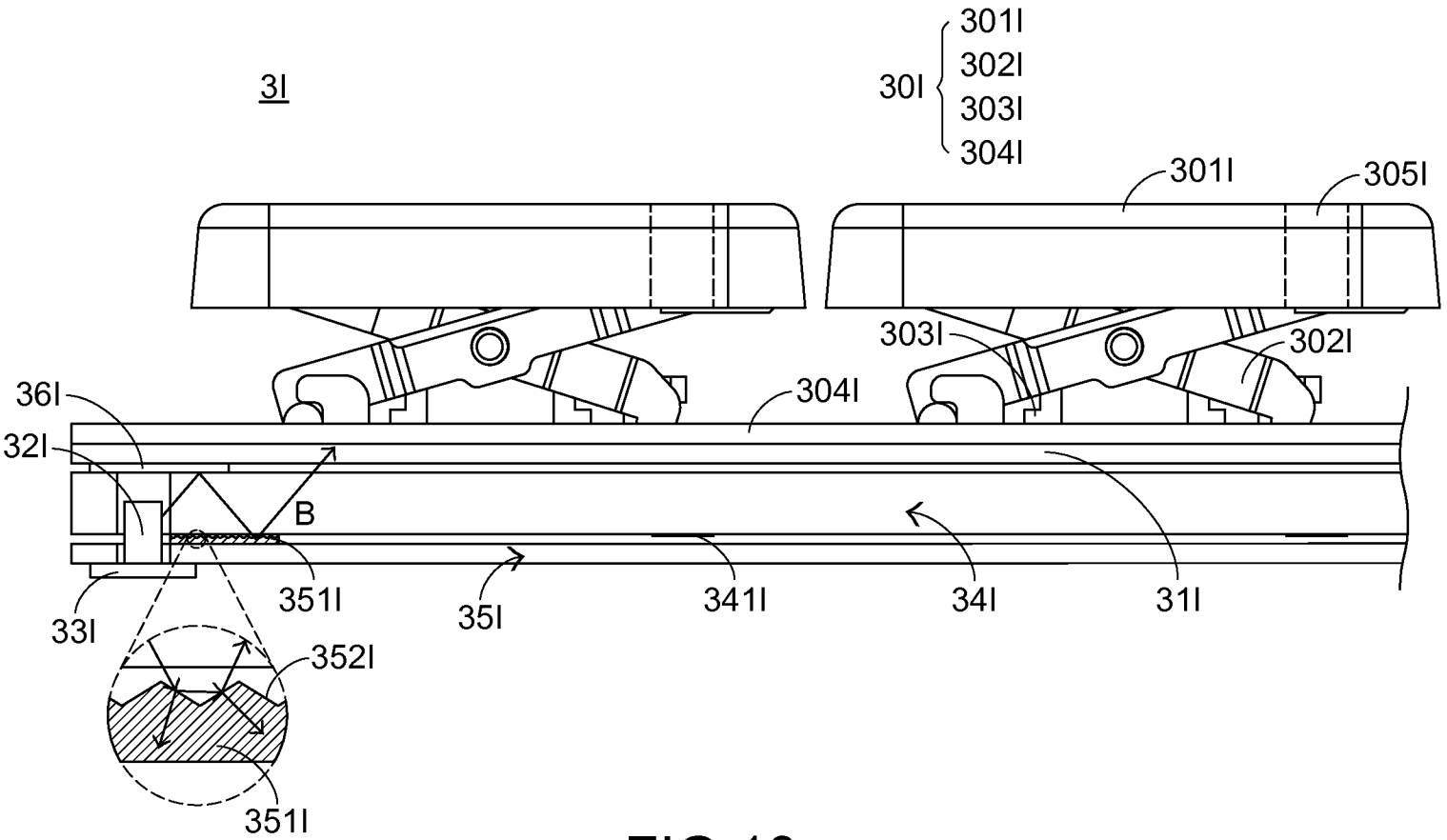
FIG. 13 is a schematic cross-sectional view illustrating the structure of a luminous keyboard according to a ninth embodiment of the present invention.

The present invention further provides a luminous keyboard of a ninth embodiment, which is distinguished from the above embodiments. FIG. 13 is a schematic cross-sectional view illustrating the structure of a luminous keyboard according to a ninth embodiment of the present invention. As shown in FIG. 13, the luminous keyboard 3I comprises a keypad module 30I, a supporting plate 31I, plural light-emitting elements 32I, an illumination circuit board 33I, a light guide plate 34I, a reflecting plate 35I and a light-shading plate 36I. For clarification and brevity, only one light-emitting element 32I is shown in the drawing. The keypad module 30I comprises plural keycaps 301I, plural connecting elements 302I, plural elastic elements 303I and a switch circuit member 304I. Each keycap 301I has a light-outputting zone 305I. The light guide plate 34I comprises plural light-guiding structures 341I. Each light-guiding structure 341I is aligned with the corresponding light-outputting zone 305I. Moreover, the reflecting plate 35I comprises plural light amount control structures 351I corresponding to the plural light-emitting elements 32I. For brevity, only one light amount control structure 351I is shown in the drawing. The components of the luminous keyboard 3I of this embodiment which are similar to the luminous keyboard 3A of the first embodiment are not redundantly described herein. In comparison with the first embodiment, the light amount control structures 351I of the luminous keyboard 3I of this embodiment have respective texturing structures 352I.

Please refer to FIG. 13 again. The light amount control structures 351I are arranged between the reflecting plate 35I and the light guide plate 34I, and disposed on a top surface of the reflecting plate 35I. That is, the light amount control structures 351I are located at specified regions near the corresponding light-emitting elements 32I. The texturing structures 352I are formed on the top surfaces of the corresponding light amount control structures 351I. By the texturing structures 352I, the number of times that the light beams B are reflected is increased, and the reflected fraction of the light beams B is reduced. When the portions of the plural light beams B that are not subjected to total internal reflection within the light guide plate 34I are projected to the light amount control structures 351I, the plural light beams B are reflected for many times by the texturing structures 352I because of the uneven surfaces of the texturing structures 352I. In particular, when the light beams B are projected on the texturing structures 352I at a first time, portions of the light beams B are reflected by the texturing structures 352I and thus projected on the texturing structures 352I at a second time. The remaining portions of the light beams that are not reflected are absorbed by the light amount control structures 351I. The operations of the reflected light beams projected on the texturing structures 352I at the second time are similar to the operations of the light beams projected on the texturing structures 352I at the first time. Consequently, less amount of the light beams B is reflected by the texturing structures 352I. In other words, after the light beams B are projected on the texturing structures 352I for many times, the number of times that the light beams B are reflected is increased and the reflected fraction of the light beams B is reduced. Since the light beams are not very centralized, the problem of generating bright spots will be diminished. Under this circumstance, the luminous uniformity is enhanced.

Figure 14:
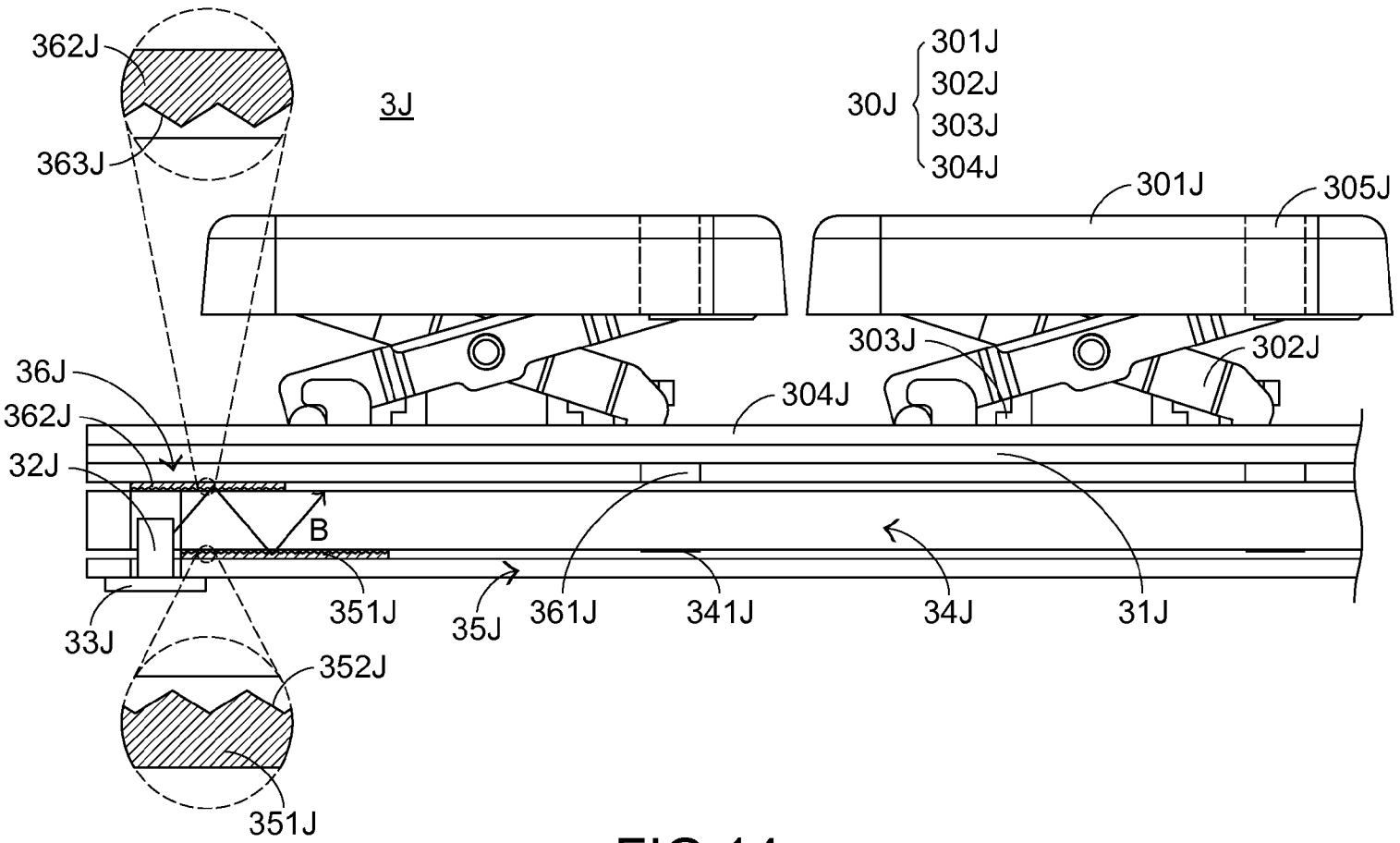
FIG. 14 is a schematic cross-sectional view illustrating the structure of a luminous keyboard according to a tenth embodiment of the present invention.

The present invention further provides a luminous keyboard of a tenth embodiment, which is distinguished from the above embodiments. FIG. 14 is a schematic cross-sectional view illustrating the structure of a luminous keyboard according to a tenth embodiment of the present invention. As shown in FIG. 14, the luminous keyboard 3J comprises a keypad module 30J, a supporting plate 31J, plural light-emitting elements 32J, an illumination circuit board 33J, a light guide plate 34J, a first reflecting plate 35J and a second reflecting plate 36J. For clarification and brevity, only one light-emitting element 32J is shown in the drawing. The keypad module 30J comprises plural keycaps 301J, plural connecting elements 302J, plural elastic elements 303J and a switch circuit member 304J. Each keycap 301J has a light-outputting zone 305J. The light guide plate 34J comprises plural light-guiding structures 341J. Each light-guiding structure 341J is aligned with the corresponding light-outputting zone 305E. The second reflecting plate 36J further comprises plural openings 361J. Each opening 361J is aligned with the corresponding light-outputting zone 305J. The components of the luminous keyboard 3J of this embodiment which are similar to the luminous keyboard 3I of the ninth embodiment are not redundantly described herein. In comparison with the ninth embodiment, the following two aspects of the luminous keyboard 3J of this embodiment are distinguished. Firstly, the luminous keyboard 3J of this embodiment is not equipped with the light-shading plate, and the second reflecting plate 36J can replace the light-shading plate. Secondly, the second reflecting plate 36J of the luminous keyboard 3J comprises plural openings 361J and plural second light amount control structures 362J (only one is shown in the drawing).

As shown in FIG. 14, plural first light amount control structures 351J are arranged between the first reflecting plate 35J and the light guide plate 34J, and disposed on a top surface of the first reflecting plate 35J. That is, the first light amount control structures 351J are located at specified regions near the corresponding light-emitting elements 32J. The plural second light amount control structures 362J are arranged between the second reflecting plate 36J and the light guide plate 34J. That is, the second light amount control structures 362J are disposed on a bottom surface of the second reflecting plate 36J, and located at specified regions near the corresponding light-emitting elements 32J. Moreover, the first light amount control structures 351J have respective first texturing structures 352J, and the second light amount control structures 362J have respective second texturing structures 363J. The first light amount control structures 351J are not overlapped with the corresponding second light amount control structures 362J. The propagating processes of the light beams B through the second light amount control structures 362J and the second texturing structures 363J are similar to those of the luminous keyboard 3I of the ninth embodiment, and are not redundantly described herein.

The structure of the luminous keyboard 3J of this embodiment may be modified. For example, in a variant example, only the first light amount control structures are disposed on the top surface of the first reflecting plate, or only the second light amount control structures are disposed on the bottom surface of the second reflecting plate. That is, only one reflecting plate has the light amount control structures. In another variant example, the plural light-emitting elements and the illumination circuit board are inverted. By changing the locations of some components, different stack structures of the luminous keyboard can be produced. These stack structures can diminish the problem of generating bright spots.

Figure 15:
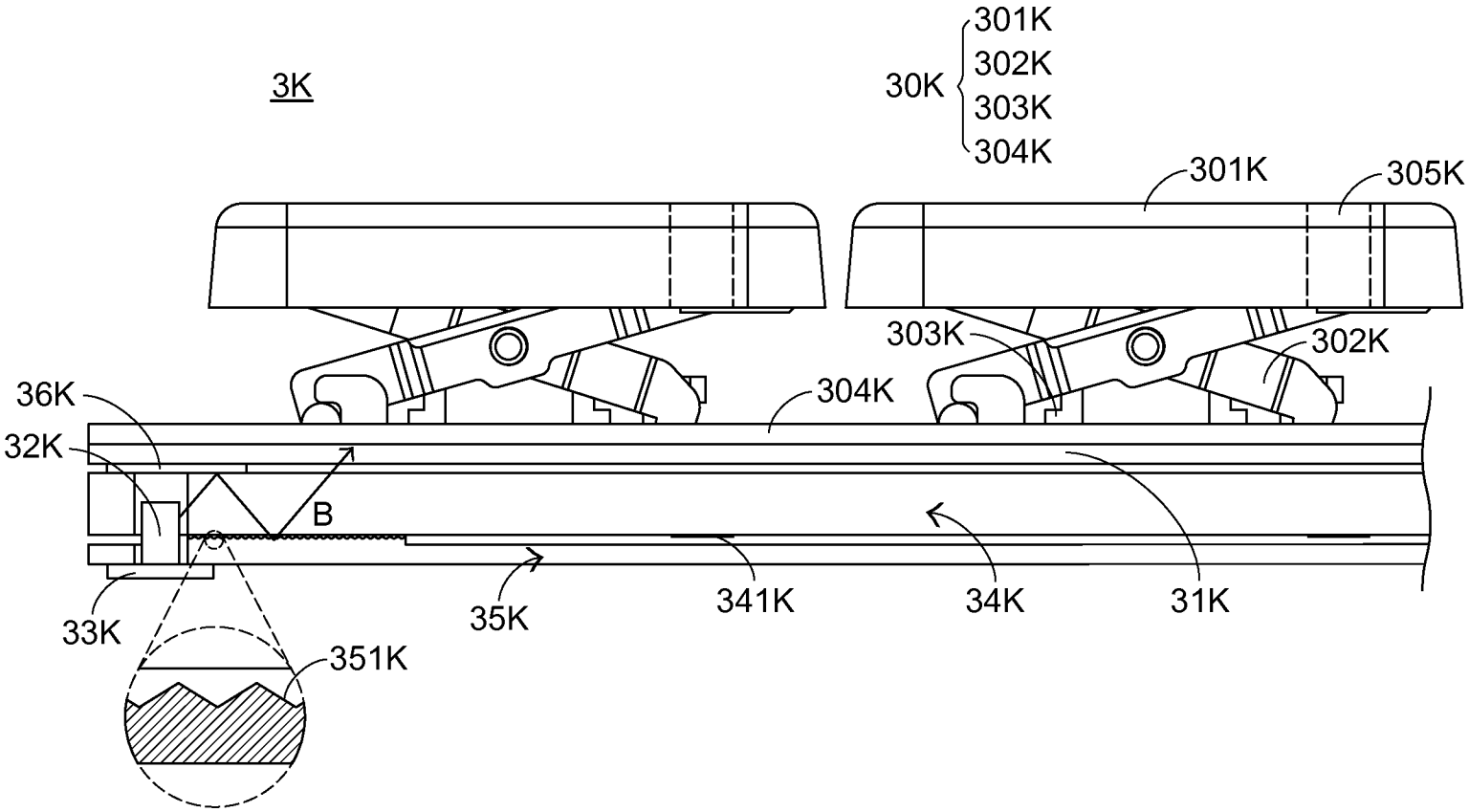
FIG. 15 is a schematic cross-sectional view illustrating the structure of a luminous keyboard according to an eleventh embodiment of the present invention.

The present invention further provides a luminous keyboard of an eleventh embodiment, which is distinguished from the above embodiment. FIG. 15 is a schematic cross-sectional view illustrating the structure of a luminous keyboard according to an eleventh embodiment of the present invention. As shown in FIG. 15, the luminous keyboard 3K comprises a keypad module 30K, a supporting plate 31K, plural light-emitting elements 32K, an illumination circuit board 33K, a light guide plate 34K, a reflecting plate 35K and a light-shading plate 36K. For clarification and brevity, only one light-emitting element 32K is shown in the drawing. The keypad module 30K comprises plural keycaps 301K, plural connecting elements 302K, plural elastic elements 303K and a switch circuit member 304K. Each keycap 301K has a light-outputting zone 305K. The light guide plate 34K comprises plural light-guiding structures 341K. Each light-guiding structure 341K is aligned with the corresponding light-outputting zone 305K. Moreover, the reflecting plate 35K comprises plural light amount control structures 351K corresponding to the plural light-emitting elements 32K. For brevity, only one light amount control structure 351K is shown in the drawing. The components of the luminous keyboard 3K of this embodiment which are similar to the luminous keyboard 3A of the first embodiment are not redundantly described herein. In comparison with the first embodiment, the light amount control structures 351K of the luminous keyboard 3K of this embodiment are texturing structures, which are integrally formed with the reflecting plate 35K.

Please refer to FIG. 15 again. The light amount control structures 351K are arranged between the reflecting plate 35K and the light guide plate 34K, and disposed on a top surface of the reflecting plate 35K. That is, the light amount control structures 351K are located at specified regions near the corresponding light-emitting elements 32K. By the light amount control structures 351K, the number of times that the light beams B are reflected is increased, and the reflected fraction of the light beams B is reduced. In other words, the light amount control structures 351K are not additional light absorption materials or additional anti-reflection materials on the reflecting plate 35K. Instead, the light amount control structures 351K are texturing structures that are formed by machining the reflecting plate 35K. Although the structures of the luminous keyboard 3K of this embodiment are somewhat different from the structures of the luminous keyboards of the above embodiments, the luminous keyboard 3K also has enhanced luminous uniformity. The illumination of the luminous keyboard 3K is similar to the illumination of the luminous keyboards of the above embodiments, and is not redundantly described herein.

Figure 16:
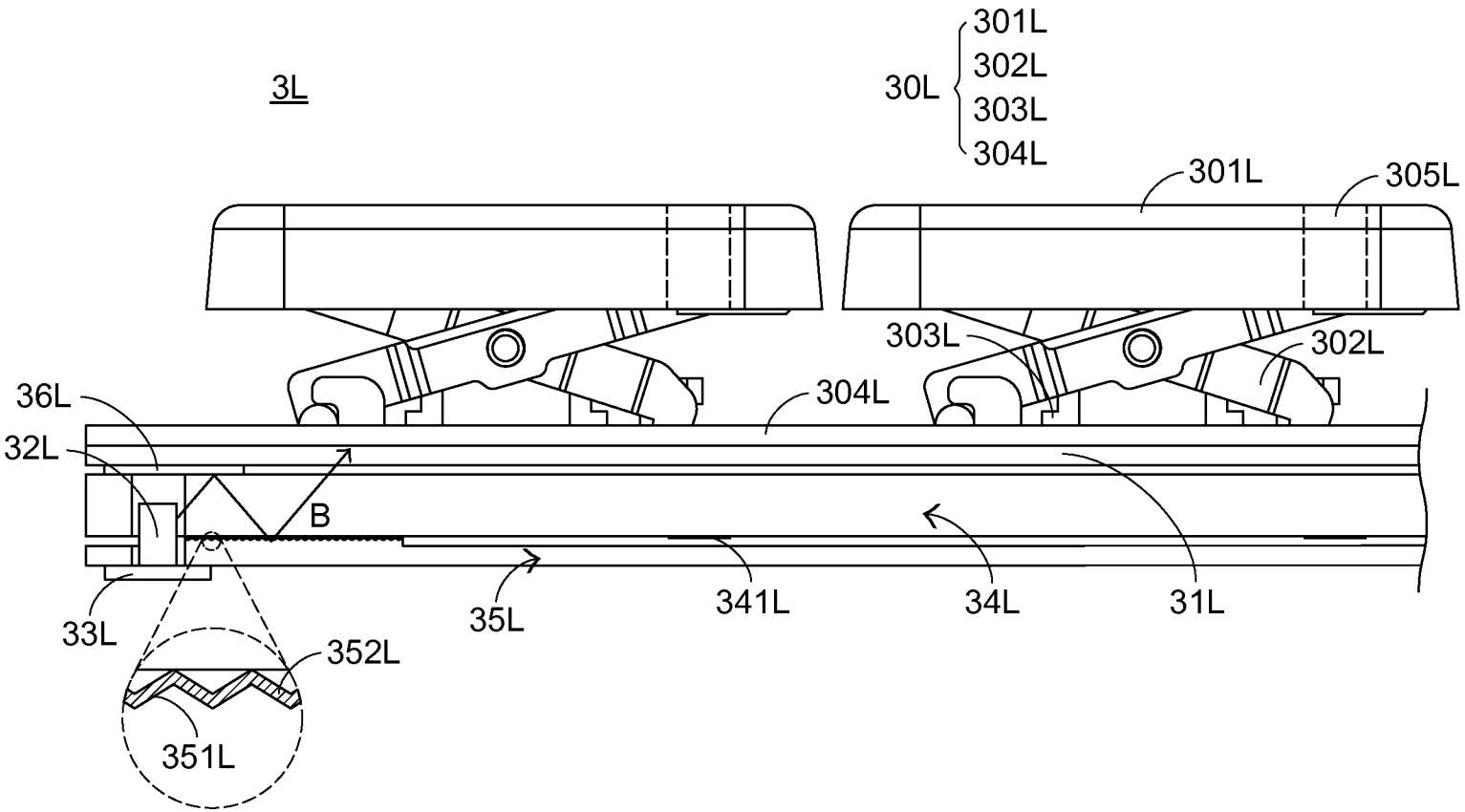
FIG. 16 is a schematic cross-sectional view illustrating the structure of a luminous keyboard according to a twelfth embodiment of the present invention.

The present invention further provides a luminous keyboard of a twelfth embodiment, which is distinguished from the above embodiment. FIG. 16 is a schematic cross-sectional view illustrating the structure of a luminous keyboard according to a twelfth embodiment of the present invention. As shown in FIG. 16, the luminous keyboard 3L comprises a keypad module 30L, a supporting plate 31L, plural light-emitting elements 32L, an illumination circuit board 33L, a light guide plate 34L, a reflecting plate 35L and a light-shading plate 36L. For clarification and brevity, only one light-emitting element 32L is shown in the drawing. The keypad module 30L comprises plural keycaps 301L, plural connecting elements 302L, plural elastic elements 303L and a switch circuit member 304L. Each keycap 301L has a light-outputting zone 305L. The light guide plate 34L comprises plural light-guiding structures 341L. Each light-guiding structure 341L is aligned with the corresponding light-outputting zone 305L. Moreover, the reflecting plate 35L comprises plural light amount control structures 351L corresponding to the plural light-emitting elements 32L. For brevity, only one light amount control structure 351L is shown in the drawing. The components of the luminous keyboard 3L of this embodiment which are similar to the luminous keyboard 3K of the eleventh embodiment are not redundantly described herein. In comparison with the eleventh embodiment, the light amount control structures 351L of the luminous keyboard 3L of this embodiment further comprises plural light absorption structures 352L corresponding to the plural light-emitting elements 32L.

Please refer to FIG. 16 again. The light absorption structures 352L are disposed on the uneven surfaces of the corresponding light amount control structures 351L (i.e., texturing structures). The portions of the plural light beams B that are not subjected to total internal reflection within the light guide plate 34L will be absorbed by the light absorption structures 352L. Consequently, the reflected fraction of the plural light beams B is reduced. Moreover, the shapes of the light absorption structures 352L match the shapes of the corresponding light amount control structures 351L (i.e., texturing structures). That is, the light absorption structures 352L also have uneven surfaces. The light absorption structures 352L can absorb portions of the light beams B and increase the number of times of reflecting the light beams B. Consequently, the reflected fraction of the light beams B is further reduced.

Figure 17:
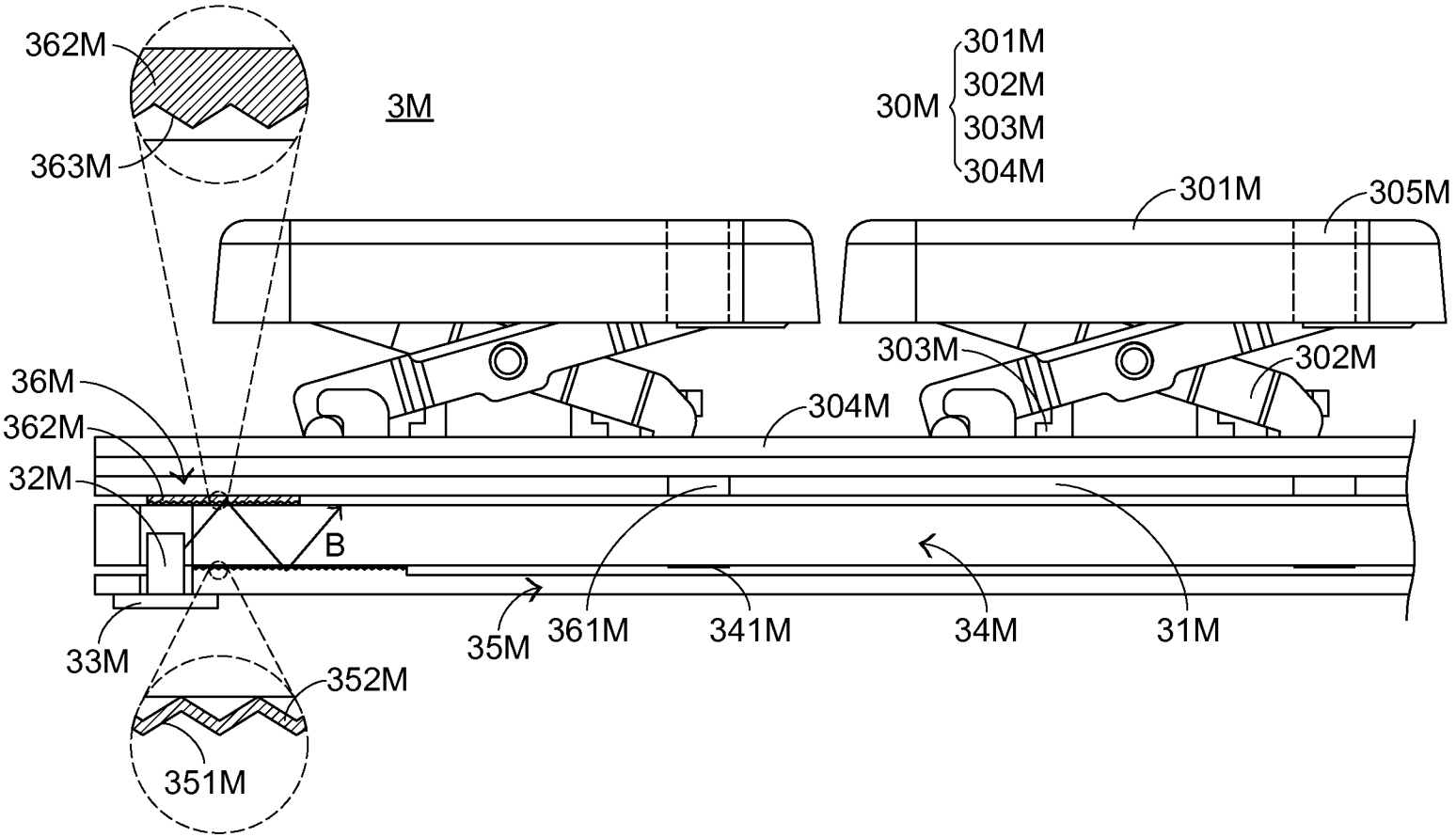
FIG. 17 is a schematic cross-sectional view illustrating the structure of a luminous keyboard according to a thirteenth embodiment of the present invention.

The present invention further provides a luminous keyboard of a thirteenth embodiment, which is distinguished from the above embodiments. FIG. 17 is a schematic cross-sectional view illustrating the structure of a luminous keyboard according to a thirteenth embodiment of the present invention. As shown in FIG. 17, the luminous keyboard 3M comprises a keypad module 30M, a supporting plate 31M, plural light-emitting elements 32M, an illumination circuit board 33M, a light guide plate 34M, a first reflecting plate 35M and a second reflecting plate 36M. For clarification and brevity, only one light-emitting element 32M is shown in the drawing. The keypad module 30M comprises plural keycaps 301M, plural connecting elements 302M, plural elastic elements 303M and a switch circuit member 304M. Each keycap 301M has a light-outputting zone 305M. The light guide plate 34M comprises plural light-guiding structures 341M. Each light-guiding structure 341M is aligned with the corresponding light-outputting zone 305M. The second reflecting plate 36M further comprises plural openings 361M. Each opening 361M is aligned with the corresponding light-outputting zone 305M. The components of the luminous keyboard 3M of this embodiment which are similar to the luminous keyboard 3L of the twelfth embodiment are not redundantly described herein. In comparison with the ninth embodiment, the following two aspects of the luminous keyboard 3M of this embodiment are distinguished. Firstly, the luminous keyboard 3M of this embodiment is not equipped with the light-shading plate, and the second reflecting plate 36M can replace the light-shading plate. Secondly, the second reflecting plate 36M of the luminous keyboard 3M comprises plural openings 361M and plural second light amount control structures 362M (only one is shown in the drawing).

As shown in FIG. 17, plural first light amount control structures 351M are integrally formed with the first reflecting plate 35M to be first texturing structures. The plural first light amount control structures 351M are arranged between the first reflecting plate 35M and the light guide plate 34M, and disposed on a top surface of the first reflecting plate 35M. That is, the first light amount control structures 351M are located at specified regions near the corresponding light-emitting elements 32M. Moreover, the first reflecting plate 35M further comprises plural light absorption structures 352M corresponding to the plural first light amount control structures 351M. The first light amount control structures 351M are disposed on the uneven surfaces of the first light amount control structures 351M (i.e., the first texturing structures). The plural second light amount control structures 362M are arranged between the second reflecting plate 36M and the light guide plate 34M. That is, the second light amount control structures 362M are disposed on a bottom surface of the second reflecting plate 36M, and located at specified regions near the corresponding light-emitting elements 32M. Moreover, the second light amount control structures 362M have respective second texturing structures 363M. The first light amount control structures 351M are not overlapped with the corresponding second light amount control structures 362M. The propagating processes of the light beams B through the first light amount control structures 351M and the light absorption structures 352M and the propagating processes of the light beams B through the second light amount control structures 362M and the second texturing structures 363M are similar to those of the luminous keyboard 3I of the ninth embodiment, and are not redundantly described herein.

The structure of the luminous keyboard 3M of this embodiment may be modified. For example, in a variant example, only the first light amount control structures are disposed on the top surface of the first reflecting plate, or only the second light amount control structures are disposed on the bottom surface of the second reflecting plate. That is, only one reflecting plate has the light amount control structures. In another variant example, the plural light-emitting elements and the illumination circuit board are inverted. By changing the locations of some components, different stack structures of the luminous keyboard can be produced. These stack structures can diminish the problem of generating bright spots.

Figure 18:
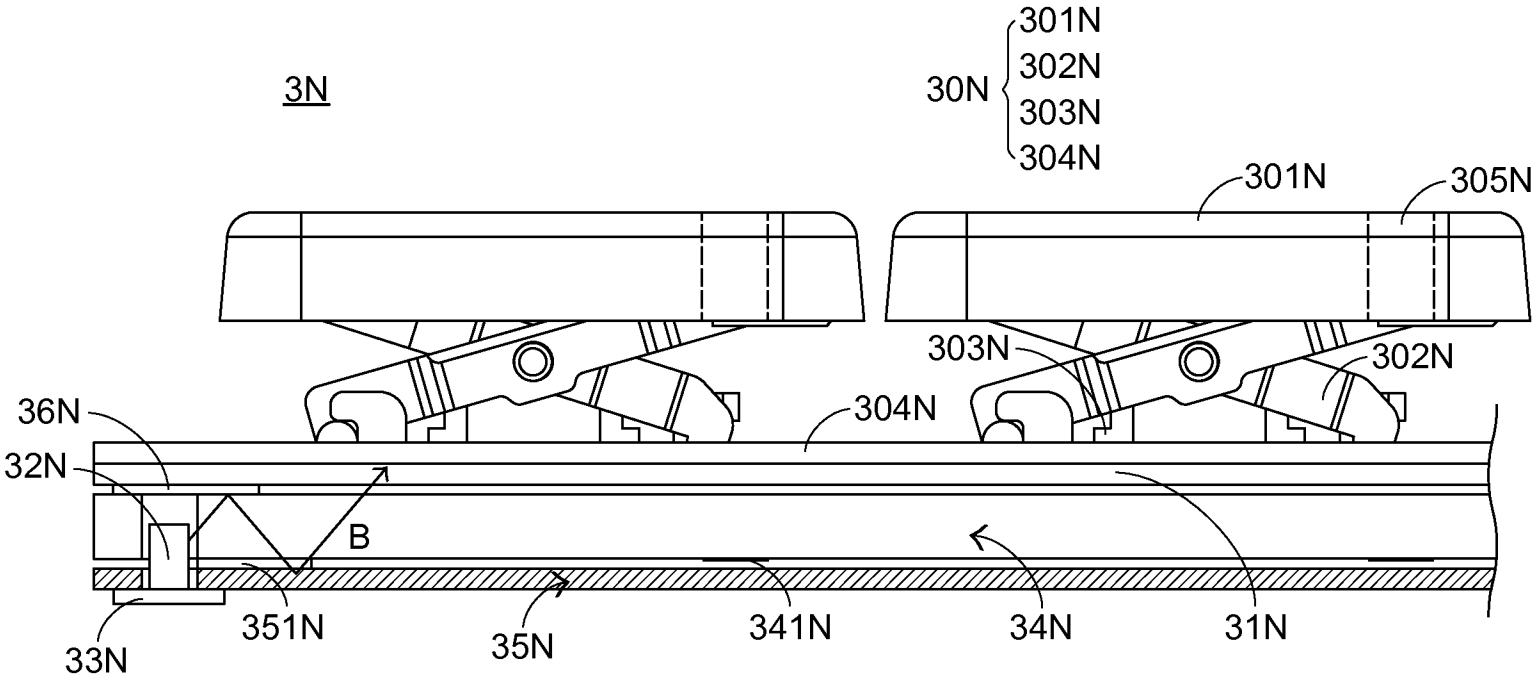
FIG. 18 is a schematic cross-sectional view illustrating the structure of a luminous keyboard according to a fourteenth embodiment of the present invention.

The present invention further provides a luminous keyboard of a fourteenth embodiment, which is distinguished from the above embodiments. FIG. 18 is a schematic cross-sectional view illustrating the structure of a luminous keyboard according to a fourteenth embodiment of the present invention. As shown in FIG. 18, the luminous keyboard 3N comprises a keypad module 30N, a supporting plate 31N, plural light-emitting elements 32N, an illumination circuit board 33N, a light guide plate 34N, a light absorption plate 35N and a light-shading plate 36N. For clarification and brevity, only one light-emitting element 32N is shown in the drawing. The keypad module 30N comprises plural keycaps 301N, plural connecting elements 302N, plural elastic elements 303N and a switch circuit member 304N. Each keycap 301N has a light-outputting zone 305N. The light guide plate 34N comprises plural light-guiding structures 341N. Each light-guiding structure 341N is aligned with the corresponding light-outputting zone 305N. Moreover, the light absorption plate 35N comprises plural light amount control structures 351N corresponding to the plural light-emitting elements 32N. For brevity, only one light amount control structure 351N is shown in the drawing. The components of the luminous keyboard 3N of this embodiment which are similar to the luminous keyboard 3A of the first embodiment are not redundantly described herein. In comparison with the first embodiment, the luminous keyboard 3N of this embodiment further comprises the light absorption plate 35N in replace of the reflecting plate.

As shown in FIG. 18, the light absorption plate 35N is disposed under the light guide plate 34N. The portions of the plural light beams B that are not subjected to total internal reflection within the light guide plate 34N will be reflected by the light absorption plate 35N. Consequently, the utilization efficiency of the portions of the plural light beams B that are not subjected to total internal reflection will be enhanced. Moreover, the light absorption plate 35N comprises plural light amount control structures 351N corresponding to the plural light-emitting elements 32N. For brevity, only one light amount control structure 351N is shown in the drawing. The light amount control structures 351N are disposed on a top surface of the light absorption plate 35N, and located near the corresponding light-emitting elements 32N. That is, the plural light amount control structures 351N are arranged between the light absorption plate 35N and the light guide plate 34N, and located at specified regions near the corresponding light-emitting elements 32N. In this embodiment, the plural light amount control structures 351N are made of anti-reflection materials and deposited on the top surface of the light absorption plate 35N. Moreover, the light absorption plate 35N is made of a light absorption material.

The illumination of the luminous keyboard 3N will be illustrated as follows. When the plural light-emitting elements 32N emit the plural light beams B, portions of the light beams B are laterally introduced into the light guide plate 34N and subjected to total internal reflection within the light guide plate 34N. The light beams B can be guided to the corresponding light-outputting zones 305N by the light-guiding structures 341N so as to illuminate the light-outputting zones 305N. On the other hand, other portions of the plural light beams B are introduced into the light guide plate 34N at a larger incident angle and unable to be subjected to total internal reflection within the light guide plate 34N, and thus shaded by the light-shading plate 36N and reflected to the light guide plate 34N. The portions of the plural light beams B reflected by the second reflecting plate 36N are transmitted through the light guide plate 34N, and then transferred through the light amount control structures 351N.

When the light beams B are transferred through the light amount control structures 351N, portions of the light beams B are absorbed by the light amount control structures 351N. The remaining small portions of the light beams B are transmitted through the light amount control structures 351N and absorbed and reflected by the underlying light absorption plate 35N, and no longer shaded by the light-shading plate 36N. Consequently, the remaining small portions of the light beams B are projected to the keycaps 301N and not directly projected to the light-outputting zones 305N. Since the light beams are not very centralized, the problem of generating bright spots will be diminished. Under this circumstance, the luminous uniformity is enhanced.

Although the light absorption plate 35N is not a reflecting plate, the light absorption plate 35N has reflecting capability to a certain extent. The reflecting capability of the light absorption plate 35N is lower than the reflecting capability of the reflecting plate. That is, the light absorption plate 35N can absorb portions of the light beams B, and the portions of the light beams B that are not absorbed will be reflected to the keycaps 301N by the light absorption plate 35N.

Figure 19:
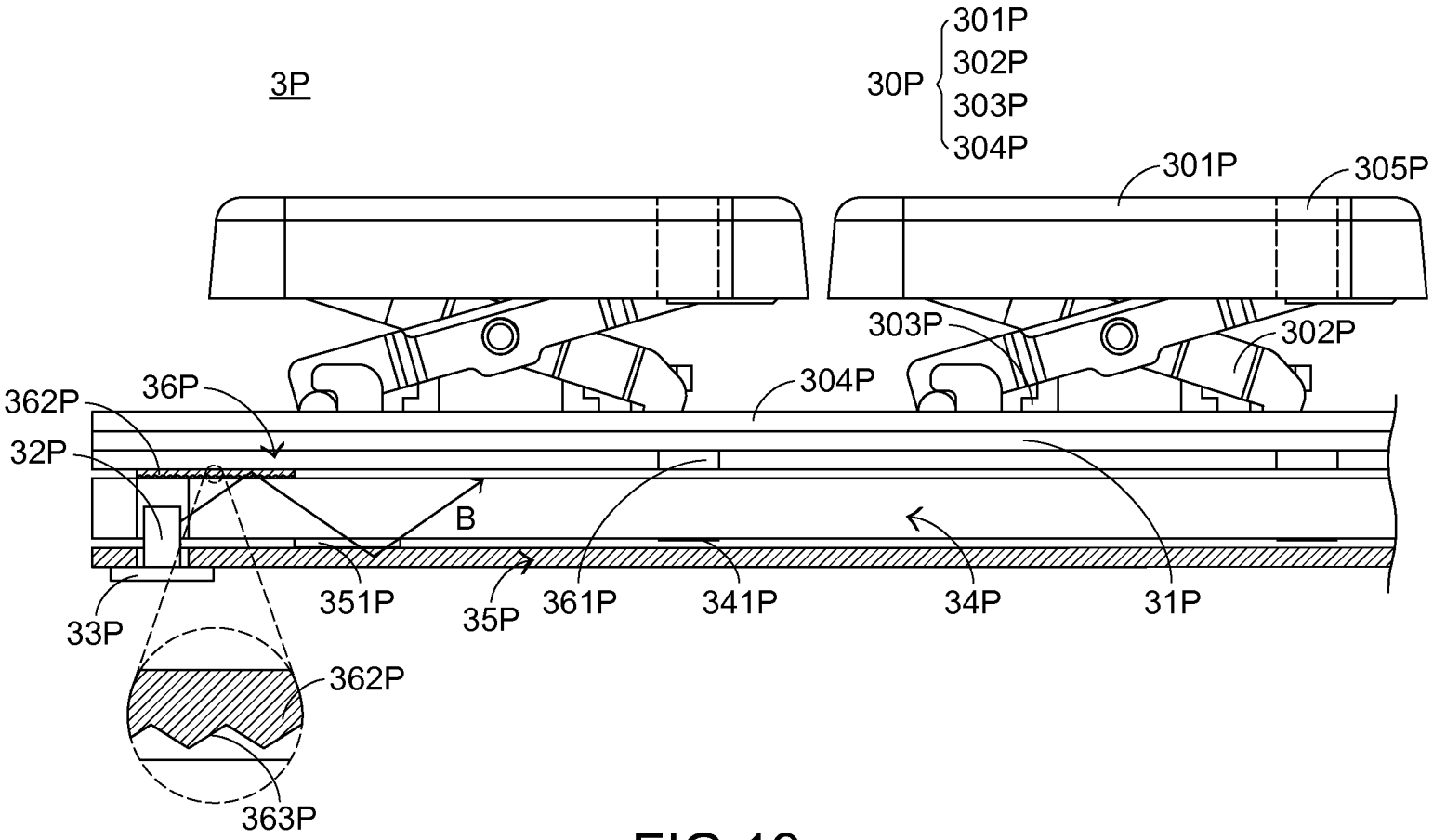
FIG. 19 is a schematic cross-sectional view illustrating the structure of a luminous keyboard according to a fifteenth embodiment of the present invention.

The present invention further provides a luminous keyboard of a fifteenth embodiment, which is distinguished from the above embodiments. FIG. 19 is a schematic cross-sectional view illustrating the structure of a luminous keyboard according to a fifteenth embodiment of the present invention. As shown in FIG. 19, the luminous keyboard 3P comprises a keypad module 30P, a supporting plate 31P, plural light-emitting elements 32P, an illumination circuit board 33P, a light guide plate 34P, a first light absorption plate 35P and a second light absorption plate 36P. For clarification and brevity, only one light-emitting element 32P is shown in the drawing. The keypad module 30P comprises plural keycaps 301P, plural connecting elements 302P, plural elastic elements 303P and a switch circuit member 304P. Each keycap 301P has a light-outputting zone 305P. The light guide plate 34P comprises plural light-guiding structures 341P. Each light-guiding structure 341P is aligned with the corresponding light-outputting zone 305P. Moreover, the second light absorption plate 36P comprises plural openings 361P. Each opening 361P is aligned with the corresponding light-outputting zone 305P. The components of the luminous keyboard 3P of this embodiment which are similar to the luminous keyboard 3N of the fourteenth embodiment are not redundantly described herein. In comparison with the fourteenth embodiment, the following two aspects of the luminous keyboard 3P of this embodiment are distinguished. Firstly, the luminous keyboard 3P of this embodiment is not equipped with the light-shading plate, and the second light absorption plate 36P can replace the light-shading plate. Secondly, the second light absorption plate 36P of the luminous keyboard 3P comprises plural openings 361P and plural second light amount control structures 362P (only one is shown in the drawing).

The plural second light amount control structures 362P are arranged between the second light absorption plate 36P and the light guide plate 34P. That is, the second light amount control structures 362P are disposed on a bottom surface of the second light absorption plate 36P, and located at specified regions near the corresponding light-emitting elements 32P. Moreover, the second light amount control structures 362P have respective second texturing structures 363P. The first light amount control structures 351P are not overlapped with the corresponding second light amount control structures 362P. The propagating processes of the light beams B through the second light amount control structures 362P and the second texturing structures 363P are similar to those of the luminous keyboard 3I of the ninth embodiment, and are not redundantly described herein.

The structure of the luminous keyboard 3P of this embodiment may be modified. For example, in a variant example, only the first light amount control structures are disposed on the top surface of the first light absorption plate, or only the second light amount control structures are disposed on the bottom surface of the second light absorption plate. That is, only one light absorption plate has the light amount control structures. In another variant example, the plural light-emitting elements and the illumination circuit board are inverted. By changing the locations of some components, different stack structures of the luminous keyboard can be produced. These stack structures can diminish the problem of generating bright spots.

Figure 20:
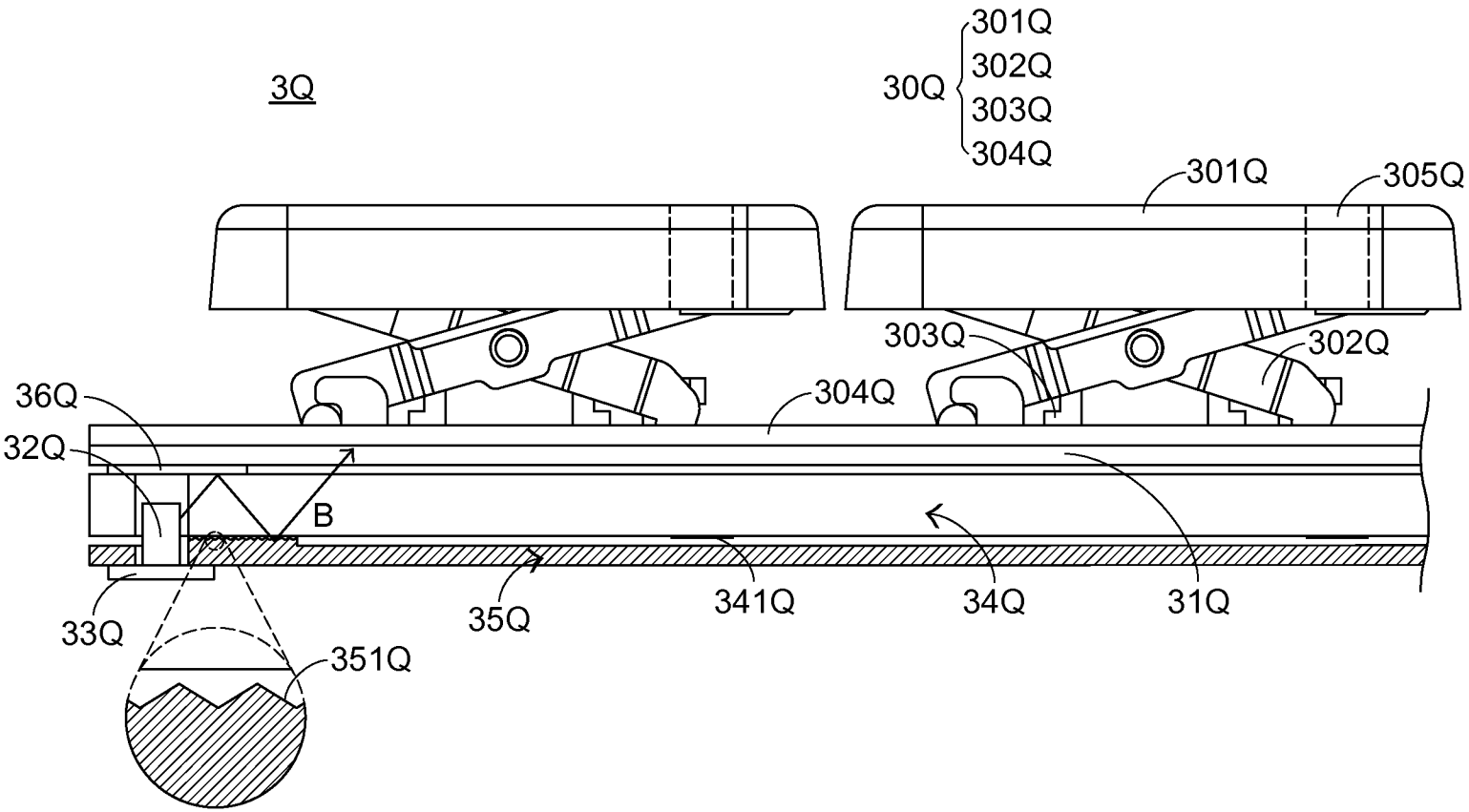
FIG. 20 is a schematic cross-sectional view illustrating the structure of a luminous keyboard according to a sixteenth embodiment of the present invention.

The present invention further provides a luminous keyboard of a sixteenth embodiment, which is distinguished from the above embodiments. FIG. 20 is a schematic cross-sectional view illustrating the structure of a luminous keyboard according to a sixteenth embodiment of the present invention. As shown in FIG. 20, the luminous keyboard 3N comprises a keypad module 30Q, a supporting plate 31Q, plural light-emitting elements 32Q, an illumination circuit board 33Q, a light guide plate 34Q, a light absorption plate 35Q and a light-shading plate 36Q. For clarification and brevity, only one light-emitting element 32Q is shown in the drawing. The keypad module 30Q comprises plural keycaps 301Q, plural connecting elements 302Q, plural elastic elements 303Q and a switch circuit member 304Q. Each keycap 301Q has a light-outputting zone 305Q. The light guide plate 34Q comprises plural light-guiding structures 341Q. Each light-guiding structure 341Q is aligned with the corresponding light-outputting zone 305Q. Moreover, the light absorption plate 35Q comprises plural light amount control structures 351Q corresponding to the plural light-emitting elements 32Q. For brevity, only one light amount control structure 351Q is shown in the drawing. The components of the luminous keyboard 3Q of this embodiment which are similar to the luminous keyboard 3A of the first embodiment are not redundantly described herein. In comparison with the first embodiment, the light amount control structures 351Q of the luminous keyboard 3Q of this embodiment are texturing structures, which are integrally formed with the light absorption plate 35Q.

Please refer to FIG. 20 again. The light amount control structures 351Q are arranged between the light absorption plate 35Q and the light guide plate 34Q, and disposed on a top surface of the light absorption plate 35Q. That is, the light amount control structures 351Q are located at specified regions near the corresponding light-emitting elements 32Q. By the light amount control structures 351Q, the number of times that the light beams B are reflected is increased, and the reflected fraction of the light beams B is reduced. In other words, the light amount control structures 351Q are not additional light absorption materials or additional anti-reflection materials on the light absorption plate 35Q. Instead, the light amount control structures 351Q are texturing structures that are formed by machining the light absorption plate 35Q. Although the structures of the luminous keyboard 3Q of this embodiment are somewhat different from the structures of the luminous keyboards of the above embodiments, the luminous keyboard 3Q also has enhanced luminous uniformity. The illumination of the luminous keyboard 3Q is similar to the illumination of the luminous keyboards of the above embodiments, and is not redundantly described herein.

Figure 21:
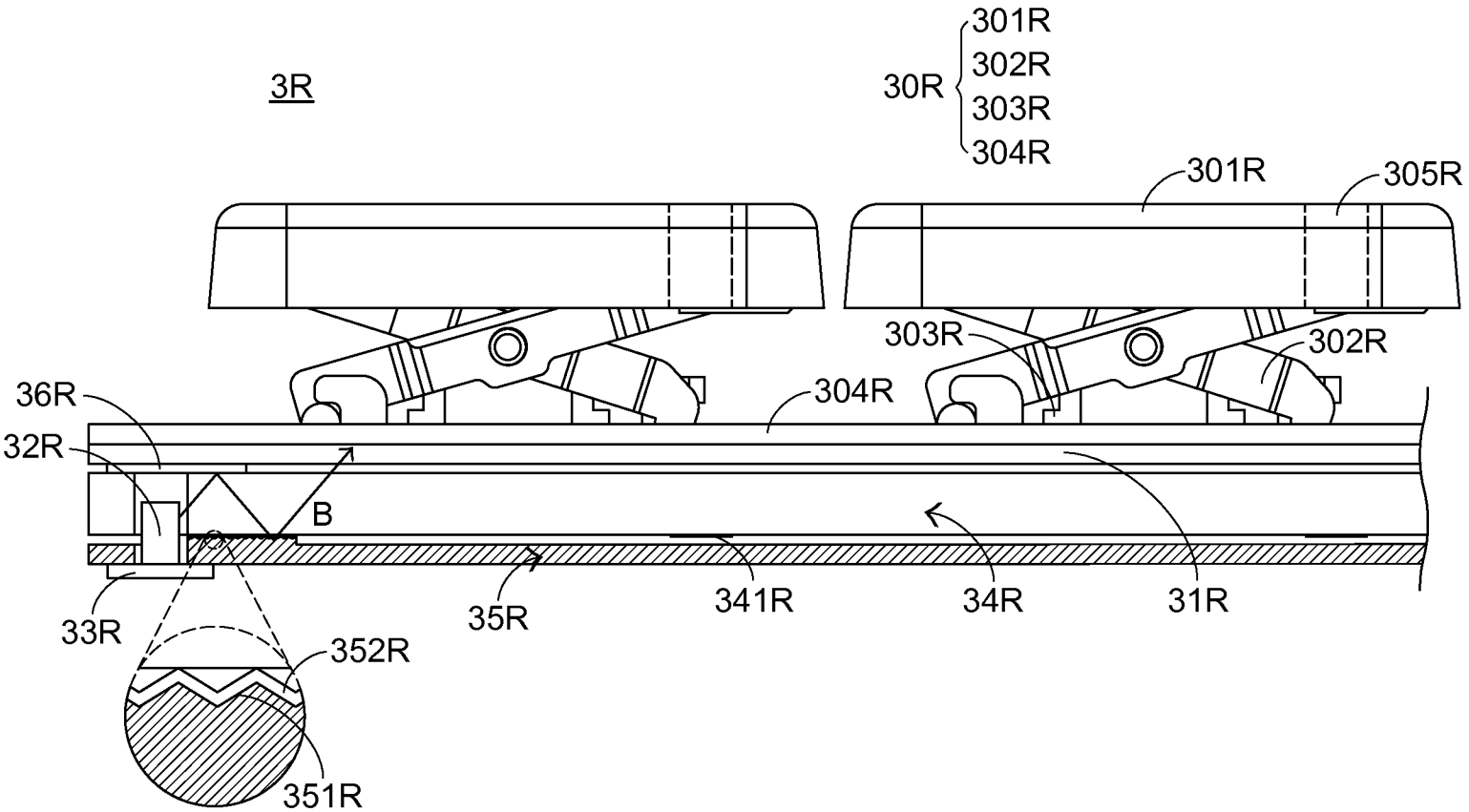
FIG. 21 is a schematic cross-sectional view illustrating the structure of a luminous keyboard according to a seventeenth embodiment of the present invention.

The present invention further provides a luminous keyboard of a seventeenth embodiment, which is distinguished from the above embodiments. FIG. 21 is a schematic cross-sectional view illustrating the structure of a luminous keyboard according to a seventeenth embodiment of the present invention. As shown in FIG. 21, the luminous keyboard 3R comprises a keypad module 30R, a supporting plate 31R, plural light-emitting elements 32R, an illumination circuit board 33R, a light guide plate 34R, a light absorption plate 35R and a light-shading plate 36R. For clarification and brevity, only one light-emitting element 32R is shown in the drawing. The keypad module 30R comprises plural keycaps 301R, plural connecting elements 302R, plural elastic elements 303R and a switch circuit member 304R. Each keycap 301R has a light-outputting zone 305R. The light guide plate 34R comprises plural light-guiding structures 341R. Each light-guiding structure 341R is aligned with the corresponding light-outputting zone 305R. Moreover, the light absorption plate 35R comprises plural first light amount control structures 351R corresponding to the plural light-emitting elements 32R. For brevity, only one first light amount control structure 351R is shown in the drawing. The components of the luminous keyboard 3R of this embodiment which are similar to the luminous keyboard 3K of the eleventh embodiment are not redundantly described herein. In comparison with the eleventh embodiment, the light absorption plate 35R of the luminous keyboard 3R of this embodiment further comprises plural second light amount control structures 352R corresponding to the first light amount control structures 351R.

Please refer to FIG. 21 again. The second light amount control structures 352R are disposed on the uneven surfaces of the corresponding first light amount control structures 351R (i.e., texturing structures). The portions of the plural light beams B that are not subjected to total internal reflection within the light guide plate 34R will be absorbed by the second light amount control structures 352R. Consequently, the reflected fraction of the plural light beams B is reduced. Moreover, the shapes of the second light amount control structures 352R match the shapes of the corresponding first light amount control structures 351R (i.e., texturing structures). That is, the second light amount control structures 352R also have uneven surfaces. In an embodiment, the plural second light amount control structures 352R are made of anti-reflection materials, and the plural second light amount control structures 352R are deposited on a top surface of the light absorption plate 35R. The second light amount control structures 352R can absorb portions of the light beams B and increase the number of times of reflecting the light beams B. Consequently, the reflected fraction of the light beams B is further reduced.

The structure of the luminous keyboard 3R of this embodiment may be modified. For example, in a variant example, the luminous keyboard further comprises a second light absorption plate over the light guide plate. Preferably, plural second first light amount control structures are disposed on the second light absorption plate. Alternatively, only the first light amount control structures are disposed on the top surface of the first light absorption plate, or only the second light amount control structures are disposed on the bottom surface of the second light absorption plate. That is, only one light absorption plate has the light amount control structures. In another variant example, the plural light-emitting elements and the illumination circuit board are inverted. By changing the locations of some components, different stack structures of the luminous keyboard can be produced. These stack structures can diminish the problem of generating bright spots.

Figure 22:
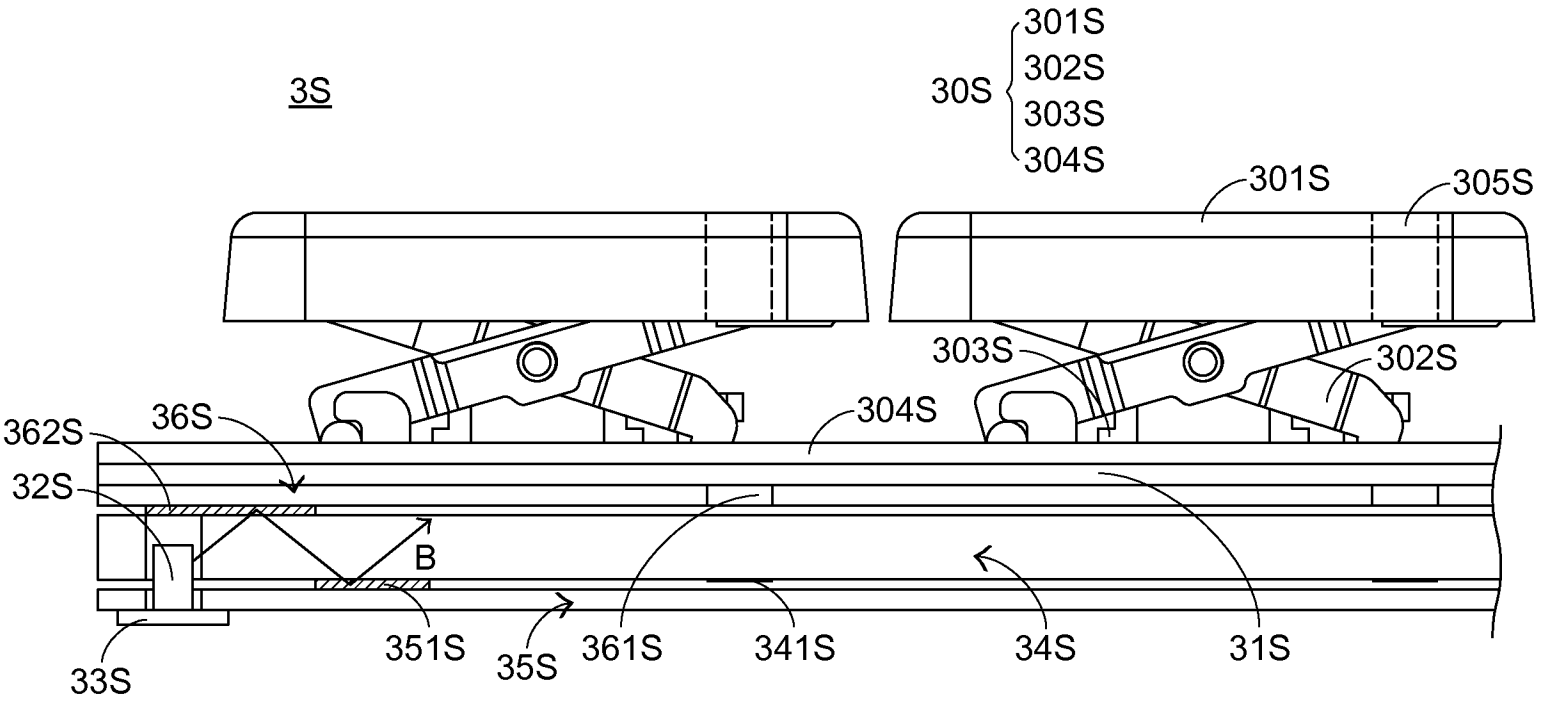
FIG. 22 is a schematic cross-sectional view illustrating the structure of a luminous keyboard according to an eighteenth embodiment of the present invention.

The present invention further provides a luminous keyboard of an eighteenth embodiment, which is distinguished from the above embodiments. FIG. 22 is a schematic cross-sectional view illustrating the structure of a luminous keyboard according to an eighteenth embodiment of the present invention. As shown in FIG. 22, the luminous keyboard 3S comprises a keypad module 30S, a supporting plate 31S, plural light-emitting elements 32S, an illumination circuit board 33S, a light guide plate 34S, a first reflecting plate 35S and a second reflecting plate 36S. For clarification and brevity, only one light-emitting element 32S is shown in the drawing. The keypad module 30S comprises plural keycaps 301S, plural connecting elements 302S, plural elastic elements 303S and a switch circuit member 304S. Each keycap 301S has a light-outputting zone 305S. The light guide plate 34S comprises plural light-guiding structures 341S. Each light-guiding structure 341S is aligned with the corresponding light-outputting zone 305S. The first reflecting plate 35S comprises plural first light amount control structures 351S (only one is shown in the drawing), and the second reflecting plate 36S comprises plural second light amount control structures 362S (only one is shown in the drawing). The components of the luminous keyboard 3S of this embodiment which are similar to the luminous keyboard 3E of the fifth embodiment are not redundantly described herein. In comparison with the fifth embodiment, the plural first light amount control structures 351S and the plural second light amount control structures 362S of the luminous keyboard 3S are not overlapped.

From the above descriptions, the present invention provides a luminous keyboard. The luminous keyboard has a reflecting plate (or a light absorption plate) with a special structure. In particular, plural light amount control structures with many variant examples are disposed on the reflecting plate (or the light absorption plate), and the light amount control structures are arranged between a light guide plate and the reflecting plate (or the light absorption plate). That is, the light amount control structures are located at the reflecting path of the light beams. When the portions of the light beams that are not subjected to total internal reflection within the light guide plate are reflected by the reflecting plate (or the light absorption plate), the reflected fraction of the light beams is reduced by the light amount control structure. Since the light beams are not very centralized, the problem of generating bright spots will be diminished. For further reducing the reflected fraction of the light beams, the light amount control structures of the luminous keyboard may have different lengths according to the practical requirements.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all modifications and similar structures.

What is claimed is:

1. A luminous keyboard, comprising:

a keypad module exposed to a top surface of the luminous keyboard;

at least one light-emitting element disposed under the keypad module, and emitting at least one light beam;

a light guide plate disposed under the keypad module, wherein the at least one light beam is subjected to total internal reflection within the light guide plate and guided to the keypad module by the light guide plate; and a reflecting plate disposed over or under the light guide plate, wherein a portion of the at least one light beam that is not subjected to total internal reflection within the light guide plate is reflected by the reflecting plate, wherein the reflecting plate has at least one light amount control structure, and the at least one light amount control structure is disposed on a top surface or a bottom surface of the reflecting plate and located near the at least one light-emitting element, wherein when the portion of the at least one light beam that is not subjected to total internal reflection within the light guide plate is transferred through the at least one light amount control structure, a reflected fraction of the at least one light beam is reduced by the at least one light amount control structure, wherein the at least one light amount control structure has a corresponding texturing structure, wherein the texturing structure is disposed on a top surface or a bottom surface of at least one light absorption structure, wherein the texturing structure increases a number of times the at least one light beam is internally reflected so as to reduce the reflected fraction of the at least one light beam.

2. The luminous keyboard according to claim 1, wherein the luminous keyboard further comprises an additional reflecting plate, and the additional reflecting plate is disposed over or under the light guide plate, wherein the reflecting plate and the additional reflecting plate are disposed on opposite surfaces of the light guide plate, wherein the portion of the at least one light beam that is not subjected to total internal reflection within the light guide plate is reflected by the additional reflecting plate, wherein the additional reflecting plate has at least one additional light amount control structure, and the at least one additional light amount control structure is arranged between the additional reflecting plate and the light guide plate and located near the corresponding light-emitting element, wherein the portion of the at least one light beam that is not subjected to total internal reflection within the light guide plate is absorbed by the at least one additional light amount control structure, so that the reflected fraction of the at least one light beam is reduced, wherein the at least one light amount control structure and the corresponding additional light amount control structure are overlapped, or the at least one light amount control structure and the corresponding additional light amount control structure are not overlapped.

3. The luminous keyboard according to claim 2, wherein the at least one additional light amount control structure is arranged between the additional reflecting plate and the light guide plate, wherein the portion of the at least one light beam that is not subjected to total internal reflection within the light guide plate is partially absorbed by the at least one additional light amount control structure, so that the reflected fraction of the at least one light beam is reduced, wherein the at least one additional light amount control structure is made of a light absorption material.

4. The luminous keyboard according to claim 1, wherein the luminous keyboard further comprises a supporting plate under the keypad module, and the keypad module is supported on the supporting plate, wherein the keypad module comprises:

plural keys exposed to the top surface of the luminous keyboard, wherein each of the plural keys comprises:

a keycap exposed to the top surface of the luminous keyboard, wherein the keycap comprises a light-outputting zone, wherein after the at least one light beam is guided by the light guide plate, the at least one light beam is transmitted through the light-outputting zone;

a connecting element arranged between the supporting plate and the keycap, wherein by the connecting element, the supporting plate and the keycap are connected with each other, and the keycap is movable upwardly and downwardly relative to the supporting plate; and an elastic element disposed under the keycap, and providing an elastic force to the keycap, wherein the keycap is returned to an original position in response to the elastic force; and a switch circuit member disposed under the plural keys, wherein when the switch circuit member is triggered by the plural keys, the switch circuit member generates corresponding key signals.

5. A luminous keyboard, comprising:

a keypad module exposed to a top surface of the luminous keyboard;

at least one light-emitting element disposed under the keypad module, and emitting at least one light beam;

a light guide plate disposed under the keypad module, wherein the at least one light beam is subjected to total internal reflection within the light guide plate and guided to the keypad module by the light guide plate; and a light absorption plate disposed over or under the light guide plate, wherein a portion of the at least one light beam that is not subjected to total internal reflection within the light guide plate is absorbed by the light absorption plate, wherein the light absorption plate has at least one light amount control structure, and the at least one light amount control structure is disposed on a top surface or a bottom surface of the light absorption plate and located near the corresponding light-emitting element, wherein when the portion of the at least one light beam that is not subjected to total internal reflection within the light guide plate is transferred through the at least one light amount control structure, a reflected fraction of the at least one light beam is reduced by the at least one light amount control structure, wherein the luminous keyboard further comprises an additional light absorption plate, and the additional light absorption plate is disposed over or under the light guide plate, wherein the light absorption plate and the additional light absorption plate are disposed on opposite surfaces of the light guide plate, wherein the portion of the at least one light beam that is not subjected to total internal reflection within the light guide plate is partially absorbed by the additional light absorption plate, wherein the additional light absorption plate has at least one additional light amount control structure, and the at least one additional light amount control structure is arranged between the additional light absorption plate and the light guide plate and located near the corresponding light-emitting element, wherein the at least one additional light amount control structure allows a portion of the at least one light beam to enter the additional light absorption plate, wherein the at least one light amount control structure and the corresponding additional light amount control structure are overlapped, or the at least one light amount control structure and the corresponding additional light amount control structure are not overlapped.

6. The luminous keyboard according to claim 5, wherein the luminous keyboard further comprises a supporting plate under the keypad module, and the keypad module is supported on the supporting plate, wherein the keypad module comprises:

plural keys exposed to the top surface of the luminous keyboard, wherein each of the plural keys comprises:

a keycap exposed to the top surface of the luminous keyboard, wherein the keycap comprises a light-outputting zone, wherein after the at least one light beam is guided by the light guide plate, the at least one light beam is transmitted through the light-outputting zone;

a connecting element arranged between the supporting plate and the keycap, wherein by the connecting element, the supporting plate and the keycap are connected with each other, and the keycap is movable upwardly and downwardly relative to the supporting plate; and an elastic element disposed under the keycap, and providing an elastic force to the keycap, wherein the keycap is returned to an original position in response to the elastic force; and a switch circuit member disposed under the plural keys, wherein when the switch circuit member is triggered by the plural keys, the switch circuit member generates corresponding key signals.

7. A luminous keyboard, comprising:

a keypad module exposed to a top surface of the luminous keyboard;

at least one light-emitting element disposed under the keypad module, and emitting at least one light beam;

a light guide plate disposed under the keypad module, wherein the at least one light beam is subjected to total internal reflection within the light guide plate and guided to the keypad module by the light guide plate; and a reflecting plate disposed over or under the light guide plate, wherein a portion of the at least one light beam that is not subjected to total internal reflection within the light guide plate is reflected by the reflecting plate, wherein the reflecting plate has at least one light amount control structure, and the at least one light amount control structure is disposed on a top surface or a bottom surface of the reflecting plate and located near the at least one light-emitting element, wherein when the portion of the at least one light beam that is not subjected to total internal reflection within the light guide plate is transferred through the at least one light amount control structure, a reflected fraction of the at least one light beam is reduced by the at least one light amount control structure; and wherein the at least one light amount control structure includes at least one texturing structure that is integrally formed with the reflecting plate, wherein the at least one light amount control structure is arranged between the reflecting plate and the light guide plate, disposed on the top surface or the bottom surface of the reflecting plate, and located at a specified region near the at least one light-emitting element, wherein the at least one light amount control structure increases a number of times of reflecting the at least one light beam so as to reduce the reflected fraction of the at least one light beam, and wherein the reflecting plate comprises at least one light absorption structure, wherein the at least one light absorption structure is disposed on an uneven surface of the corresponding texturing structure, wherein the portion of the at least one light beam that is not subjected to total internal reflection within the light guide plate is partially absorbed by the at least one light absorption structure, so that the reflected fraction of the at least one light beam is reduced, wherein a shape of the at least one light absorption structure matches a shape of the corresponding light amount control structure.

* * * * *